United States Patent [19]

Deguchi

[11] Patent Number: 5,024,925

[45] Date of Patent: Jun. 18, 1991

[54] METHOD OF FORMING COLOR IMAGE FROM A COLOR REVERSAL PHOTOGRAPHIC MATERIAL COMPRISING A SPECIFIED IODIDE CONTENT AND SPECTRAL DISTRIBUTION

[75] Inventor: Naoyasu Deguchi, Kanagawa, Japan

[73] Assignee: Fuji Photo Film Co., Ltd., Kanagawa, Japan

[21] Appl. No.: 383,393

[22] Filed: Jul. 21, 1989

[30] Foreign Application Priority Data

Jul. 21, 1988 [JP] Japan ..... 63-182671

[51] Int. Cl.[5] ..... G03C 7/16; G03C 1/46

[52] U.S. Cl. ..... 430/379; 430/383; 430/385; 430/387; 430/389; 430/502; 430/503; 430/505; 430/551; 430/552; 430/553

[58] Field of Search ..... 430/379, 383, 385, 387, 430/389, 502, 503, 505, 551, 552, 553

[56] References Cited

U.S. PATENT DOCUMENTS

| | | | |
|---|---|---|---|
| 3,672,898 | 6/1972 | Schwan et al. | 96/74 |
| 4,599,301 | 7/1986 | Ohashi et al. | 430/505 |
| 4,663,271 | 5/1987 | Nozawa et al. | 430/506 |
| 4,681,837 | 7/1987 | Mitsui et al. | 430/506 |
| 4,705,744 | 11/1987 | Sasaki et al. | 430/506 |
| 4,707,436 | 11/1987 | Sasaki | 430/505 |
| 4,729,943 | 3/1988 | Pfaff et al. | 430/379 |
| 4,745,048 | 5/1988 | Kishimoto et al. | 430/554 |
| 4,764,456 | 8/1988 | Watanabe et al. | 430/550 |
| 4,839,268 | 6/1989 | Bando | 430/567 |

FOREIGN PATENT DOCUMENTS 62-148943 7/1987 Japan .

*Primary Examiner*—Charles L. Bowers, Jr.
*Assistant Examiner*—Patrick A. Doody
*Attorney, Agent, or Firm*—Sughrue, Mion, Zinn, Macpeak & Seas

[57] ABSTRACT

A method of forming a color image which comprises subjecting a silver halide color reversal photographic material to imagewise exposure and then to color reversal processing, said color reversal photographic material comprising a support having provided thereon at least one red-sensitive emulsion layer, at least one green-sensitive emulsion layer and at least one blue-sensitive emulsion layer wherein the emulsion layers have an average silver iodide content of up to 5 mol %, and wherein the peak sensitivity of the red layer is in a range between 615 and 640 nm, wherein on the shorter wavelength side, 80% of the peak is in a range between 600 and 633 nm, 50% of the peak is in a range between 585 and 625 nm and 25% of the peak is in a range between 570 and 615 nm, and wherein on the longer wavelength side, 80% of the peak is in a range between 620 and 648 nm, 50% of the peak is in a range between 625 and 655 nm and 25% of the peak is in a range between 630 and 665 nm, wherein the wavelength difference between the longer and shorter side at which the sensitivity is 25% of the peak is in a range of 30 to 90 nm, and at least one layer has a means for providing an interimage effect.

12 Claims, 2 Drawing Sheets

METHOD OF FORMING COLOR IMAGE FROM A COLOR REVERSAL PHOTOGRAPHIC MATERIAL COMPRISING A SPECIFIED IODIDE CONTENT AND SPECTRAL DISTRIBUTION

FIELD OF THE INVENTION

This invention relates to a method of forming a color image and, more particularly, to a method forming a color image using a color reversal photographic material having improved color reproducibility.

BACKGROUND OF THE INVENTION

There is an extreme variety of objects which are to be photographed by color reversal films. Of such objects, some are desired to be photographed at a high shutter speed under a limited light. For example, in photographing a moving object such as in sports, a photographic picture with no blurs cannot be obtained unless the shutter is released at a high speed, i.e., unless the exposure time is shortened.

On the other hand, if the diaphragm of a camera is opened to a large extent, depth of field becomes smaller, and hence it becomes difficult to adjust the focus. Therefore, in photographing a moving object, too, a good photographic picture cannot be taken unless the diaphragm is considerably closed and a short exposure time is employed. For such purposes, light-sensitive materials with an ordinary sensitivity of 100 in ISO are insufficient in sensitivity.

Sports and other activities are in many cases conducted under indoor illumination or night illumination as well as under outdoor day light in the day time. In many cases, high speed films are used under indoor illumination or night illumination not only for sports. For such illumination, mercury lamps, fluorescent lamps, tungsten light, etc. are used alone or in combination. These lights are extremely different from day light in color temperature. In photographing under such illumination, a color temperature-converting filter is used for correcting color balance. However, such a filter is not of much practical use since there results a photographic finish with deteriorated sharpness and a high-speed shutter release cannot be employed due to reduction in light amount when such a filter is applied to a camera lens. On the other hand, when a high-speed color negative film is used in photographing under lights of various color temperature, color balance can be corrected when printing even if the difference in color temperature of the light source is not corrected by using a filter, and hence color unbalance of the printed picture is comparatively small.

However, when a color reversal film is used under such conditions, the finished photographic pictures show a large color unbalance due to lack of the above-described color correction.

Professional photographers often use their photographic pictures as originals for printing and, in such cases, they mostly employ color reversal films.

One of the extremely important photographic performance characteristics of high-speed color reversal film for day-light use is that change in color balance due to difference in exposure light source should be small, and hence it has been desired to provide color reversal films with such performance characteristic.

JP-B-49-6207 (corresponding to French Patent 2,004,376) (the term "JP-B" as used herein means an "examined Japanese patent publication") discloses a spectral sensitivity distribution for minimizing change in color balance for various photographing light sources.

However, this technique unavoidably involves deterioration of color reproducibility, and hence it has been eagerly desired to develop high-speed color reversal films undergoing less change in color balance due to differences in color temperature of the exposing light source without deterioration of color reproducibility.

SUMMARY OF THE INVENTION

Therefore, an object of the present invention is to provide a method of forming a color image using a high-speed color reversal photographic light-sensitive material which has a high sensitivity and an excellent color reproducibility and which undergoes less change in color balance due to difference in the exposing light source.

The above-described and other objects of the present invention can be attained by a method of forming a color image which comprises subjecting a silver halide color reversal photographic material to imagewise exposure and then to color reversal processing, said color reversal photographic material comprising a support having provided thereon at least one cyan coupler-containing red-sensitive silver halide emulsion layer, at least one magenta coupler-containing green-sensitive silver halide emulsion layer and at least one yellow coupler-containing blue-sensitive silver halide emulsion layer with the light-sensitive silver halide emulsions in said photographic material having an average silver iodide content of up to 5 mol %, a wavelength corresponding to the peak of spectral sensitivity distribution of the red-sensitive emulsion layer is in a range between 615 and 640 nm, a wavelength in shorter wavelength side of the spectral sensitivity distribution at which the sensitivity is 80% of the peak is in a range between 600 and 633 nm, a wavelength at which the sensitivity is 50% of the peak is in a range between 585 and 625 nm, a wavelength at which the sensitivity is 25% of the peak is in a range between 570 and 615 nm, a wavelength in longer wavelength side of the spectral sensitivity distribution at which the sensitivity is 80% of the peak is in a range between 620 and 648 nm, a wavelength at which the sensitivity is 50% of the peak is in a range between 625 and 655 nm, a wavelength at which the sensitivity is 25% of the peak is in a range between 630 and 665 nm, and the wavelength difference between the wavelength on the longer wavelength side at which the sensitivity is 25% of the peak and that on the shorter wavelength side at which the sensitivity is 25% of the peak is in a range of 90 to 30 nm, and the light-sensitive emulsion layers and/or a substantially light insensitive hydrophilic colloidal layer has a means for providing interimage effect.

DETAILED DESCRIPTION OF THE INVENTION

Figure 1:
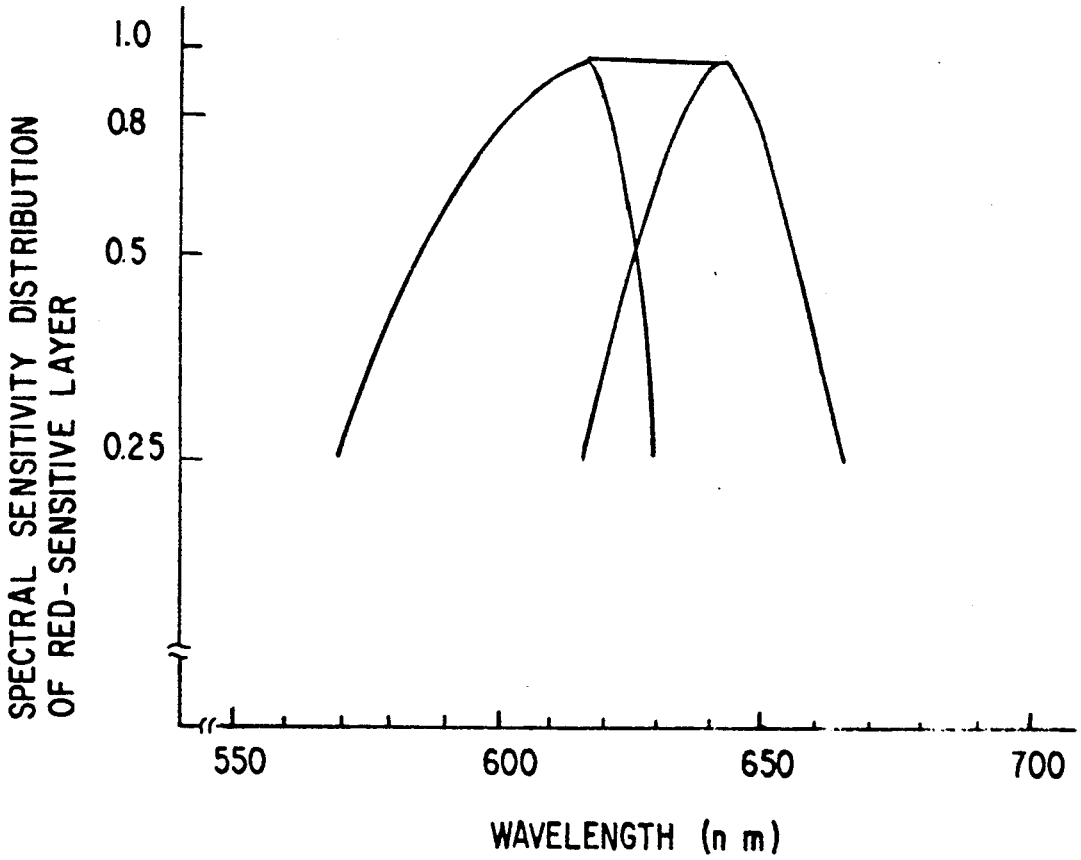
FIG. 1 shows a preferable spectral sensitivity distribution of the red-sensitive layer of a light-sensitive material in accordance with the present invention.

The present invention relates to a method of forming a color image using a silver halide color reversal photographic material having an ISO speed of 160 or more for a day light illuminant. Exposure by spectral distribution of the specific day-light illuminant of the present invention is conducted in a manner described in JIS K 7602, p. 5. Measurement of the specific sensitivity is conducted according to the method for determining ISO speed described in JIS K 7613, pp. 3 to 4 and Kodak's color reversal process E-6. The silver halide color reversal photographic material preferably an ISO speed of from 160 to 6,400.

In the present invention, average content of silver iodide in all of the light-sensitive silver halide grains is up to 5 mol %. This condition may be satisfied as a whole, that is, each emulsion can satisfy this condition, or one or two of silver halide emulsion layers may have a silver iodide content of more than 5 mol %, with other silver halide emulsion layers having a silver iodide content of less than 5 mol %. In the present invention the average content of silver iodide in all of the light-sensitive silver halide grains is preferably from 0.5 to 5.0 mol %, particularly preferably from 1 to 4.8 mol %.

The spectral sensitivity distribution of the red-sensitive emulsion layer in the present invention can be obtained by using in proper combination the sensitizing dyes represented by the following general formulae (I) and (II).

The molar ratio of the sensitizing dye represented by the general formula (I) to that represented by the general formula (II), i.e., (I)/(II), is preferably 0.05 to 4, more preferably 0.1 to 3.

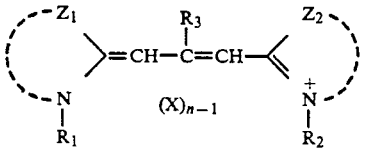

(I)

wherein $Z_1$ represents atoms necessary for constituting a hetero ring selected from among substituted or unsubstituted benzimidazole, substituted or unsubstituted benzoxazole and substituted or unsubstituted naphthoxazole, $Z_2$ represents atoms necessary for constituting a hetero ring selected from among substituted or unsubstituted benzothiazole, substituted or unsubstituted benzoselanzole, substituted or unsubstituted naphthothiazole and substituted or unsubstituted naphthoselenazole, with at least One of the hetero ring constituted by $Z_1$ or $Z_2$ being a naphtho-fused ring, $R_1$ and $R_2$ each represents a substituted or unsubstituted alkyl or a substituted or unsubstituted aralkyl group, $R_3$ represents a hydrogen atom, an alkyl group an aryl group or an aralkyl group, X represents an anion, and n represents 1 or 2 provided that n represents 1 when an inner salt is formed;

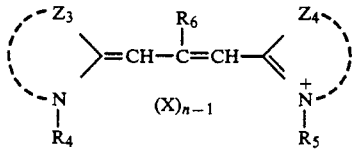

(II)

wherein $Z_3$ and $Z_4$, which may be the same or different, each represents atoms necessary for constituting a hetero ring selected from among substituted or unsubstituted benzothiazole, substituted or unsubstituted benzoselenazole, substituted or unsubstituted benzotellurazole, substituted or unsubstituted naphthothiazole and substituted or unsubstituted naphthoselenazole, $R_4$ and $R_5$ each represents a substituted or unsubstituted alkyl or a substituted or unsubstituted aralkyl group, $R_6$ represents a hydrogen atom, an alkyl group, an aryl group or an aralkyl group, X represents an anion, and n represents 1 or 2, provided that n represents 1 when an inner salt is formed.

Typical examples of the spectrally sensitizing dyes represented by the general formula (I) are shown below.

I-1

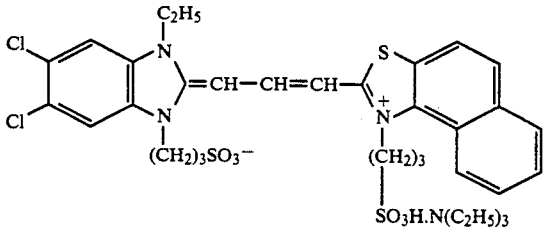

I-2

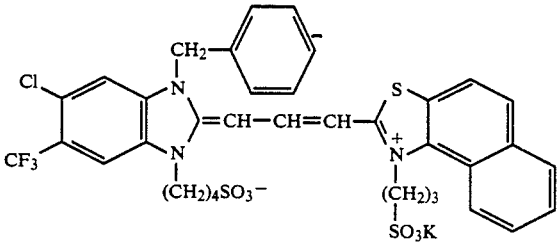

-continued
I-3
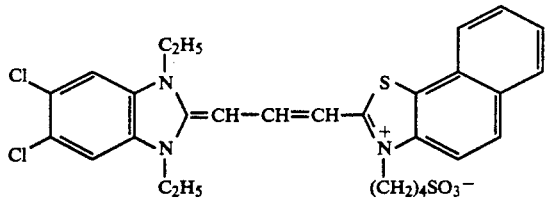
I-4
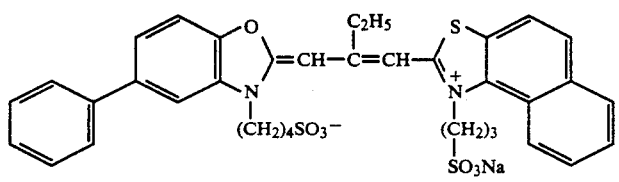
I-5
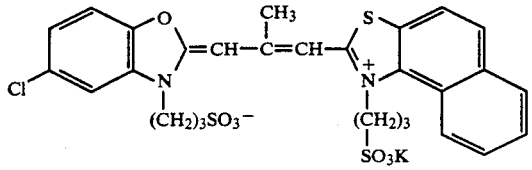
I-6
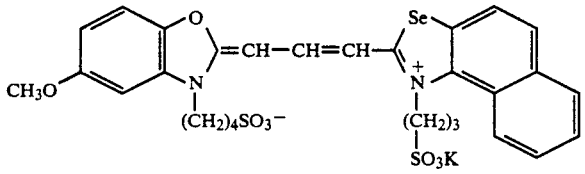
I-7
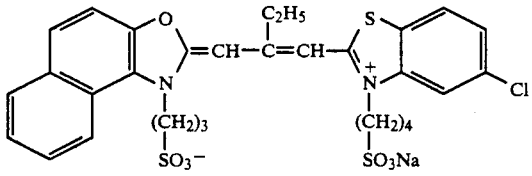
I-8
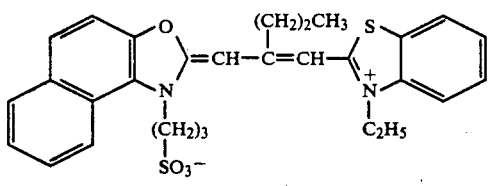
I-9
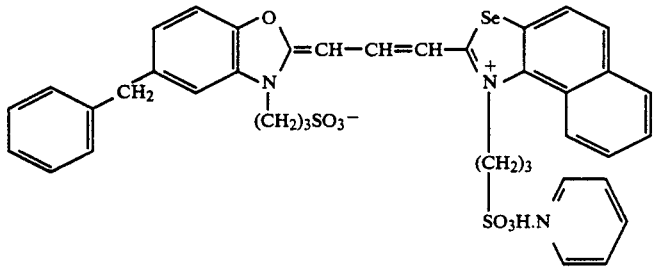
Typical examples of the spectrally sensitizing dyes represented by the general formula (II) are shown below.

II-1
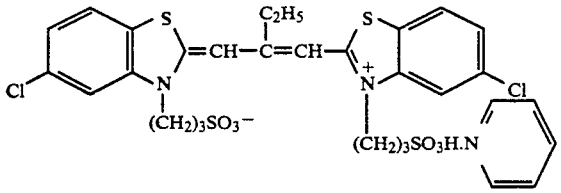
II-2
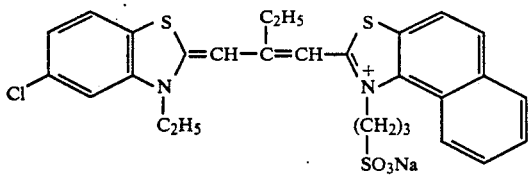
II-3
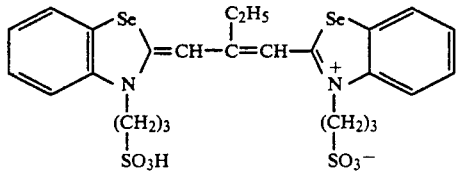
II-4
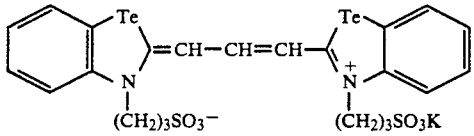
II-5
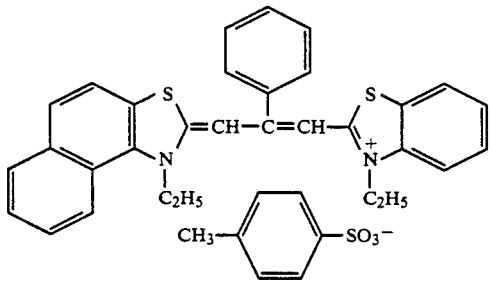
II-6
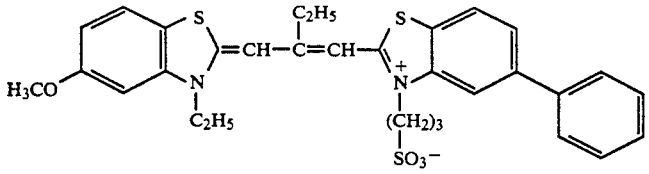
II-7
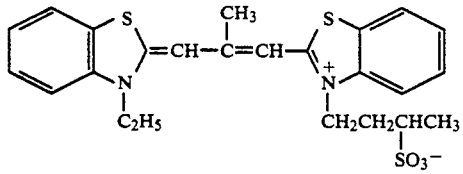
II-8
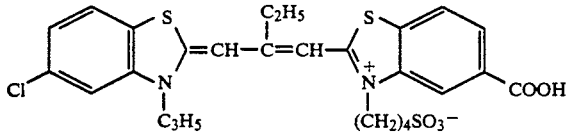

-continued

II-9

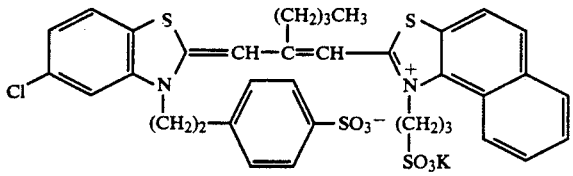

II-10

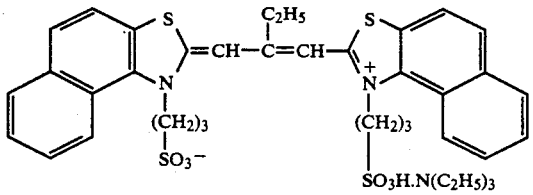

II-11

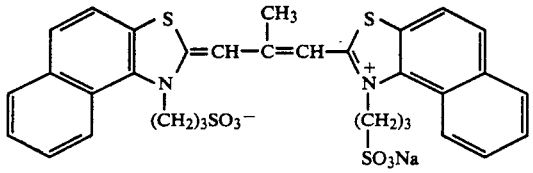

II-12

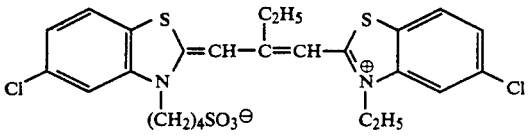

In the present invention, use of a sensitizing dye represented by the general formula (III) together with the foregoing sensitizing dyes (I) and (II) is preferable in view of adjusting the spectral sensitivity distribution.

The sensitizing dye represented by the general formula (III) is used in an amount of preferably 0 to 20 mol %, more preferably 0.1 to 15 mol %, based on the total molar amount of (I), (II) and (III).

The sensitizing dye represented by the general formula (III) is illustrated below.

(III)

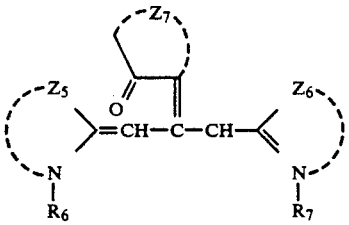

In the above general formula, $Z_5$ and $Z_6$, which may be the same or different, each represents atoms necessary for constituting a hetero ring selected from among substituted or unsubstituted benzoxazole, substituted or unsubstituted benzimidazole, substituted or unsubstituted benzothiazole, substituted or unsubstituted benzoselenazole, substituted or unsubstituted benzotellurazole, substituted or unsubstituted naphthoxazole, substituted or unsubstituted naphthothiazole, substituted or unsubstituted naphthoselenazole and naphthotellurazole, $Z_7$ represents atoms necessary for constituting a 5- or 6-membered hetero ring, and $R_6$ and $R_7$ each represents a substituted or unsubstituted alkyl or substituted or unsubstituted aralkyl group.

Typical examples of the spectrally sensitizing dyes represented by the general formula (III):

III-1

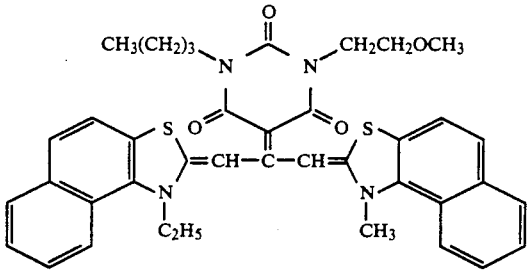

III-2

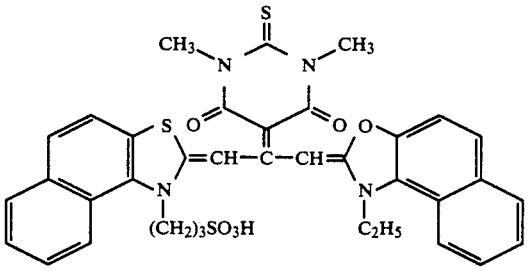

III-3

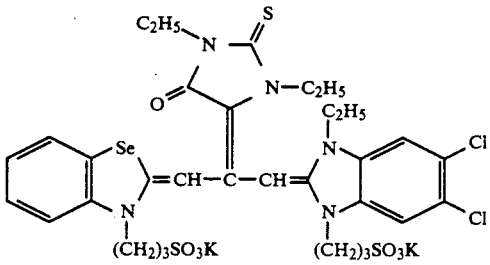

-continued

III-4

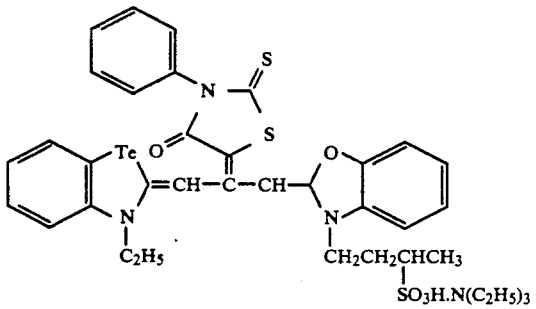

The sensitizing dyes to be used in the present invention represented by the general formulae (I), (II) and (III) are incorporated in a total amount of $1\times10^{-6}$ to $1\times10^{-2}$ mol, preferably $1\times10^{-5}$ to $5\times10^{-3}$ mol, particularly preferably $4\times10^{-5}$ to $1\times10^{-3}$ mol, per mol of silver halide in a silver halide photographic emulsion.

The sensitizing dyes to be used in the present invention may directly be dispersed in an emulsion, or may first be dissolved in a proper solvent such as methyl alcohol, ethyl alcohol, n-propanol, methylcellosolve, acetone, water, pyridine or a mixed solvent thereof and then added to an emulsion as a solution. Ultrasonic waves may be employed for dissolution.

As a means to be used in the present invention for obtaining an interimage effect, there are illustrated the following.

(1) A difference in average silver iodide content between light-sensitive layers of different color sensitivities (at least one layer for each color sensitivity) is 1 mol % or more.

(2) A compound represented by the following general formula (IV) is incorporated.

(3) A compound represented by the following general formula (V) is incorporated.

(4) A diffusible 4 thiazoline-2-thione compound or N-substituted-4-thiazoline-2-thione compound is incorporated.

(5) A silver halide emulsion containing surface-fogged silver halide grains is used.

(6) A silver halide emulsion containing interior-fogged silver halide grains is used.

(7) Colloidal silver is incorporated.

(8) An electron donor-releasing coupler is incorporated.

In order to effectively obtain the interimage effect in the present invention, means of the above-described (1) and/or at least one of the above-described (2) to (8), preferably (1) and one of (2), (3), (5) or (6), be employed in at least one light-sensitive silver halide emulsion layer and/or a substantially light-insensitive hydrophilic colloidal layer. It is preferable to employ means (2), (5), (6) and (8) in at least one light-sensitive silver halide emulsion layer and/or a substantially light-insensitive hydrophilic colloidal layer adjacent to the above-described light-sensitive silver halide emulsion layer.

Means (7) is preferably employed in the light-sensitive silver halide emulsion layers and is also preferably employed in a substantially light-insensitive hydrophilic colloidal layer which is other than a yellow filter layer and an antihalation layer and which is adjacent to the light-sensitive silver halide emulsion layer.

It is particularly preferable that the substantially light-insensitive hydrophilic colloidal layer is adjacent to a low-sensitive green-sensitive silver halide emulsion layer or a low-sensitive red-sensitive silver halide emulsion layer.

It is preferable to employ the interimage effect providing means in both of the above-described light-sensitive silver halide emulsion layer and the light-insensitive hydrophilic colloidal layer. In such a case, the means are preferably employed in the above-described emulsion layer and a light-insensitive layer adjacent thereto except for (1).

The silver halide which is preferably incorporated in the photographic emulsion layers of the photographic light-sensitive material to be used in the present invention is silver bromoiodide, silver chloroiodide or silver chlorobromoiodide containing up to about 30 mol % of silver iodide, with silver bromoiodide containing about 2 mol % to about 25 mol % of silver iodide being particularly preferable.

The average iodide content of the photographic light-sensitive material is up to 5 mol %, and a difference in average silver iodide content between adjacent emulsion layers is preferably 1 mol % or more.

The silver halide grains in the photographic emulsion may be in a regular crystal form such as cubic, octahedral or tetradecahedral form, in an irregular crystal form such as spherical or tabular form, in a form with a crystal defect such as twin plane, or in a composite form thereof.

As to grain size of the silver halide grains, both fine grains of not larger than about 0.2 μ and large-sized grains of up to about 10 μ in projected area diameter may be used. The emulsion may be a poly disperse emulsion or a monodisperse emulsion.

The silver halide photographic emulsion to be used in the present invention may be prepared according to processes described in, for example, *Research Disclosure* (RD), No. 17643 (Dec. 1978), pp. 22 to 23, "I. Emulsion preparation and types" and ibid., No. 18716 (Nov. 1979), p. 648; P. Glafkides, "Chemie et Physique Photographique" (Paul Montel, 1967), G. F. Duffin, "Photographic Emulsion Chemistry" (Focal Press, 1966), V. L. Zelikman et al, "Making and Coating Photographic Emulsion" (Focal Press, 1964), and the like.

Monodisperse emulsions described in U.S. Pat. Nos. 3,574,628 and 3,655,394 and British Patent 1,413,748, etc. are also preferable.

Tabular grains of about 5 or more in aspect ratio are also usable in the present invention. Such tabular grains may be easily prepared according to processes described in Gutoff; "Photographic Science and Engineering", vol. 14, pp. 248 to 257 (1970), U.S. Pat. Nos. 4,434,226, 4,414,310, 4,433,048, 4,439,520, British Patent 2,112,157, etc.

The crystal structure of the silver halide grains may be a uniform structure, a structure wherein the inner portion and the outer portion are different from each other in halide composition, or a layered structure, or silver halide crystals different from each other may be conjuncted to each other by epitaxial conjunction or, further, crystals conjuncted to other compounds than silver halide such as silver rhodanide or lead oxide may be used.

In addition, a mixture of grains of various crystal forms may also be used.

The silver halide emulsions to be used in the present invention are usually subjected to physical ripening, chemical ripening, and spectral sensitization before use. Additives to be used in these steps are described in *Research Disclosure* Nos. 17,643 and 18,716. Places where such additives are described are tabulated in the following table.

Known photographic additives which can be used in the present invention are also described in the above-described two *Research Disclosures*, and places where related descriptions are given are also tabulated in the following table.

| | Kind of Additive | RD17643 | RD18716 |
|---|---|---|---|
| 1 | Chemically sensitizing agents | p. 23 | p. 648, right column |
| 2 | Sensitivity-increasing agents | | p. 648, right column |
| 3 | Spectrally sensitizing agents and super-sensitizing agents | pp. 23 to 24 | p. 648, right column to p. 649 right column |
| 4 | Brightening agents | p. 24 | |
| 5 | Antifoggants and stabilizers | pp. 24 to 25 | p. 649, right column et seq. |
| 6 | Light absorbents, filter dyes and UV ray absorbents | pp. 25 to 26 | p. 649, right column to p. 650, left column |
| 7 | Stain-preventing agents | p. 25, right column | p. 650, left to right column |
| 8 | Dye image stabilizers | p. 25 | |
| 9 | Hardeners | p. 26 | p. 651, left column |
| 10 | Binders | p. 26 | p. 651, left column |
| 11 | Plasticizers and lubricants | p. 27 | p. 650, right column |
| 12 | Coating aids and surface active agents | pp. 26 to 27 | p. 650, right column |
| 13 | Antistatic agents | p. 27 | p. 650, right column |

Compounds represented by the general formula (IV) for achieving the interimage effect referred to in (2) are described below.

$$A-(Time)_t-X$$

In the general formula (IV), A means an oxidation-reduction mother nucleus and represents atoms capable of releasing $-(Time)_t-X$ only when oxidized during photographic development processing, Time represents a timing group bound to A through a sulfur atom, a nitrogen atom or an oxygen atom, t represents an integer of 0 or 1, and X represents a development inhibitor.

Firstly, A in the general formula (IV) is described in detail below. As the oxidation-reduction mother nucleus represented by A, there are illustrated, for example, hydroquinone, catechol, p-aminophenol, o-aminophenol, 1,2-naphthalenediol, 1,4-naphthalenediol, 1,6-naphthalenediol, 1,2-aminonaphthol, 1,4 aminonaphthol, 1,6-aminonaphthol, etc. The amino groups are preferably substituted by a sulfonyl group containing 1 to 25 carbon atoms or an acyl group containing 1 to 25 carbon atoms. As the sulfonyl group, there are illustrated substituted or unsubstituted aliphatic sulfonyl groups and substituted or unsubstituted aromatic sulfonyl groups and, as the acyl group, there are illustrated substituted or unsubstituted aliphatic or substituted or unsubstituted aromatic acyl groups. A hydroxyl group or an amino group forming the oxidation-reduction mother nucleus of A may be protected by a protective group capable of being eliminated upon development processing. As examples of the protective group, there are illustrated those which contain 1 to 25 carbon atoms such as an acyl group, an alkoxycarbonyl group and a carbamoyl group and, in addition, those protective groups which are described in JP-A-59-197037 (the term "JP-A" as used herein means an "unexamined published Japanese patent application") and JP-A-59-201057. The protective groups may, if possible, be bound to a substituent of A to be described hereinafter to form a 5-, 6- or 7-membered ring.

The oxidation-reduction mother nucleus represented by A may be substituted by a proper substituent or substituents as long as its redox ability is not lost. Examples of the substituents are those which contain up to 25 carbon atoms such as an alkyl group, an aryl group, an alkylthio group, an arylthio group, an alkoxy group, an aryloxy group, an amino group, an amido group, a sulfonamido group, an alkoxycarbonylamino group, an ureido group, a carbamoyl group, an alkoxycarbonyl group, a sulfamoyl group, a sulfonyl group, a cyano group, a halogen atom, an acyl group, a carboxyl group, etc.

$-(Time)_t-X$ is a group which is to be released as $\ominus-(Time)_t-X$ only when the oxidation-reduction mother nucleus represented by A undergoes a cross oxidation reaction upon development to become an oxidized form.

Time is a timing group which is bound to A through a sulfur atom, a nitrogen atom or an oxygen atom, and includes those groups which release X from $\ominus-(Time)_t-X$ having been released upon development, by a one or more step reaction. Examples of Time are described in, for example, U.S. Pat. Nos. 4,248,962 and 4,409,323, British Patent 2,096,783, U.S. Pat. No. 4,146,396, JP-A-51-146828, JP-A-57 56837, etc. As Time, a combination of two or more selected from those which are described in these documents may be used.

X means a development inhibitor. Examples of the development inhibitor include those compounds which have a mercapto group bound to a hetero ring and heterocyclic compounds capable of forming imino silver. As the compounds having a mercapto group bound to a hetero ring, there are illustrated, for example, substituted or unsubstituted mercaptoazoles, substituted or unsubstituted mercaptopyrimidines, etc. As the heterocyclic compounds capable of forming imino silver, there are illustrated, for example, substituted or unsubstituted triazoles, substituted or unsubstituted benzimidazoles, etc.

As X, those which first form a development inhibiting compound upon being eliminated from Time in the general formula (IV), then undergo some chemical reaction with a developer component to be converted to a compound which has substantially no or considerably reduced development inhibiting ability may be used. As functional groups undergoing such chemical reaction, there are illustrated, for example, an ester group, a carbonyl group, an imino group, an immonium group, a Michael addition-receptive group, an imido group, etc.

Additionally, compounds represented by the general formula (IV) are described in detail in JP-A-62103637.

Specific examples of the compounds represented by the general formula (IV) are illustrated below.

(IV-1)
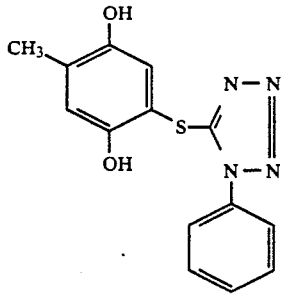
(IV-2)
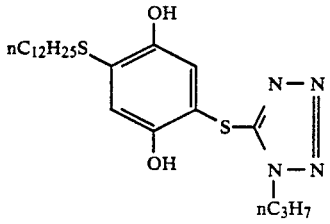
(IV-3)
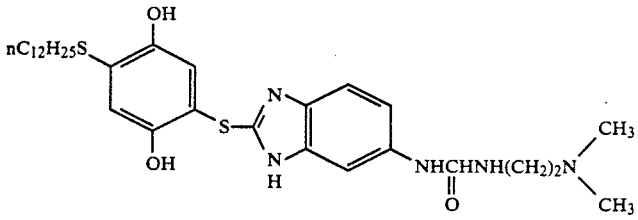
(IV-4)
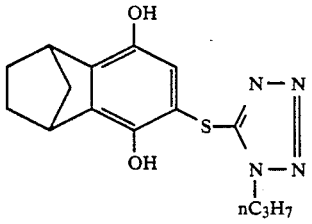
(IV-5)
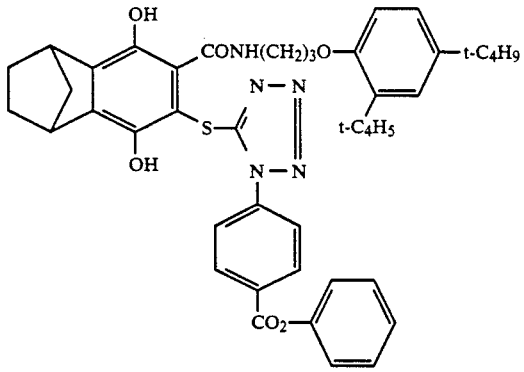
(IV-6)
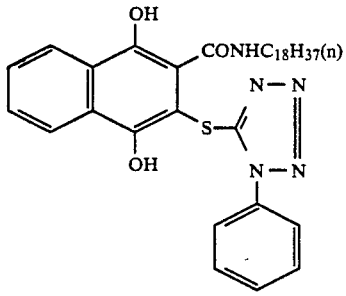

-continued (IV-7)

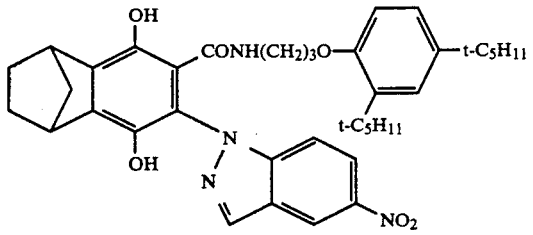

(IV-8)

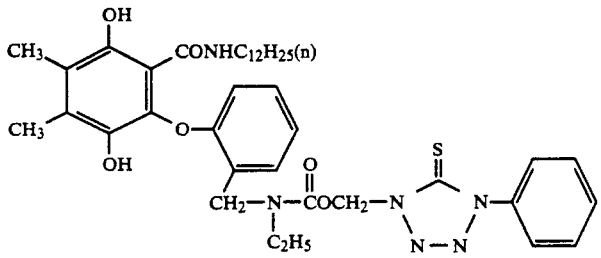

(IV-9)

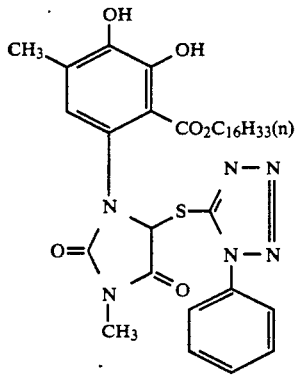

(IV-10)

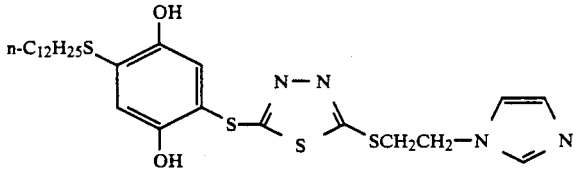

The compounds represented by the general formula (IV) may be added as an emulsion prepared by dissolving them in a high-boiling oil and stirring at high speed, or may be added as a solution in an aqueous organic solvent such as alcohol or cellosolve. In addition, they may be added to a gelatin solution, followed by stirring to disperse finely.

Compounds represented by the general formula (V) for achieving the interimage effect referred to in (3) above are described below.

General formula (V)

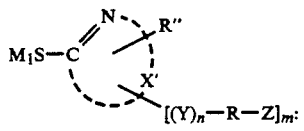

In formula (V), $M_1$ represents a hydrogen atom, a cation or a mercapto group-protecting group capable of being split with alkali, Z represents atoms necessary for forming a 5- or 6-membered hetero ring which may optionally have a substituent or substituents or may be fused. In more detail, $M_1$ represents a hydrogen atom, a cation (e.g., sodium ion, potassium ion or ammonium ion) or a mercapto group-protecting group capable of being split with alkali (e.g., —COR', —COOR' or —$CH_2CH_2COR'$, provided that R' represents a hydrogen atom, an alkyl group, an aralkyl group, an aryl group, etc.).

X' represents atoms necessary for forming a 5- or 6-membered hetero ring. This hetero ring contains a sulfur atom, a selenium atom, a nitrogen atom, an oxygen atom, etc. as hetero atom, and may be fused with a ring.

The 5- or 6-membered hetero ring includes tetrazole, triazole, imidazole, oxazole, thiadiazole, pyridine, pyrimidine, triazine, azabenzimidazole, purine, tetraazaindene, triazaindene, pentaazaindene, benzotriazole, benzimidazole, benzoxazole, benzothiazole, benzoselenazole, naphthoimidazole, etc.

R represents a straight or branched alkylene group, a straight or branched alkenylene group, a straight or branched aralkylene group or an arylene group, and Z represents a polar substituent. Y represents $$-S-,\ -O-,\ -\overset{R_1}{\overset{|}{N}}-,\ -\overset{O}{\overset{\|}{C}}-\overset{R_2}{\overset{|}{N}}-,\ -\overset{R_3}{\overset{|}{N}}-\overset{O}{\overset{\|}{C}}-,\ -SO_2\overset{R_4}{\overset{|}{N}}-,$$

-continued $$-\overset{R_5}{\overset{|}{N}}SO_2-,\ -\overset{O}{\overset{\|}{C}}O-,\ -O\overset{O}{\overset{\|}{C}}-,\ -\overset{O}{\overset{\|}{C}}-,\ -\overset{R_6}{\overset{|}{N}}-\overset{O}{\overset{\|}{C}}-\overset{R_7}{\overset{|}{N}}-,$$

$$-\overset{R_8}{\overset{|}{N}}-\overset{O}{\overset{\|}{C}}-\overset{R_9}{\overset{|}{N}}- \text{ or } -\overset{R_{10}}{\overset{|}{N}}-\overset{O}{\overset{\|}{C}}-O-;$$

wherein $R_1$, $R_2$, $R_3$, $R_4$, $R_5$, $R_6$, $R_7$, $R_8$, $R_9$ and $R_{10}$ each represents a hydrogen atom or a substituted or unsubstituted alkyl, aryl, alkenyl or aralkyl group.

R″ represents a hydrogen atom or a group capable of replacing it, n represents 0 or 1, and m represents 0, 1 or 2.

More particularly, R represents a straight or branched alkylene group, a straight or branched alkenylene group or an arylene group.

As the polar substituent represented by Z, there are illustrated, for example, a substituted or unsubstituted amino group (including salt form), a quaternary ammoniumyl group, an alkoxy group, an aryloxy group, an alkylthio group, an arylthio group, a heterocyclic thio group, a sulfonyl group, a carbamoyl group, a sulfamoyl group, a carbonamido group, a sulfonamido group, an acyloxy group, a ureido group, an acyl group, an aryloxycarbonyl group, a thioureido group, a sulfonyloxy group, a heterocyclic group and a hydroxyl group.

$R_1$, $R_2$, $R_3$, $R_4$, $R_5$, $R_6$, $R_7$, $R_8$, $R_9$ and R10 each represents a hydrogen atom, a substituted or unsubstituted alkyl group, a substituted or unsubstituted aryl group, a substituted or unsubstituted alkenyl group or a substituted or unsubstituted aralkyl group.

R″ represents a hydrogen atom or a group capable of replacing it such as a halogen atom (e.g., fluorine, chlorine or bromine), substituted or unsubstituted alkyl group containing 1 to 6 carbon atoms, a substituted or unsubstituted aryl group containing 6 to 12 carbon atoms, a substituted or unsubstituted alkoxy group containing 1 to 6 carbon atoms, a substituted or unsubstituted aryloxy group containing 6 to 12 carbon atoms, a sulfonyl group containing 1 to 12 carbon atoms, a sulfonamido group containing 1 to 12 carbon atoms, a sulfamoyl group containing 1 to 12 carbon atoms, a carbamoyl group containing 1 to 12 carbon atoms, an amido group containing 2 to 12 carbon atoms, a ureido group containing 1 to 12 carbon atoms, an aryloxy or alkoxycarbonyl group containing 2 to 12 carbon atoms, an aryloxy or alkoxycarbonylamino group containing 2 to 12 carbon atoms or a cyano group.

In the general formula (V), R preferably represents a substituted or unsubstituted alkylene group, Y represents $$-\overset{O}{\overset{\|}{C}}-\overset{R_2}{\overset{|}{N}}-,\ -S-,\ -O-,\ -\overset{R_1}{\overset{|}{N}}-,\ -\overset{R_3}{\overset{|}{N}}-\overset{O}{\overset{\|}{C}}- \text{ or } -\overset{R_6}{\overset{|}{N}}-\overset{O}{\overset{\|}{C}}-\overset{R_7}{\overset{|}{N}}-;$$

$R_2$, $R_3$, $R_6$ and $R_7$ each preferably hydrogen atom, Z preferably represents a substituted or unsubstituted amino group or its salt or a heterocyclic group.

Of the compounds represented by the general formula (V), preferable specific examples are illustrated below.

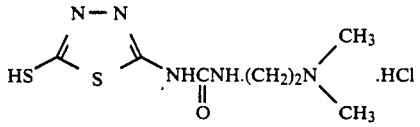

(V-1)

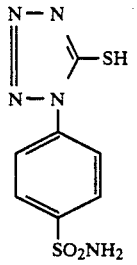

(V-2)

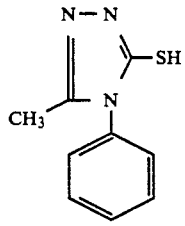

(V-3)

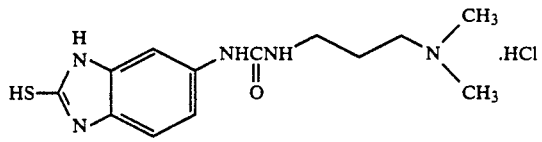

(V-4)

-continued (V-5)

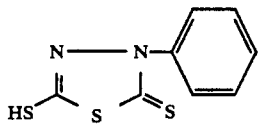

(v-6)

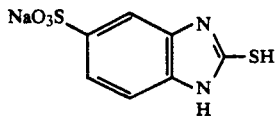

(V-7)

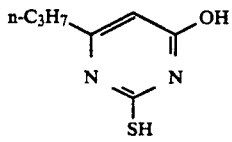

(V-8)

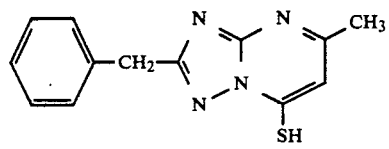

(V-9)

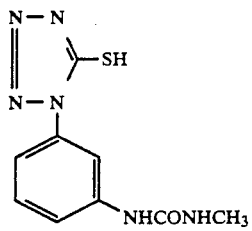

(V-10)

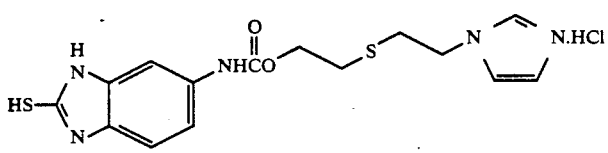

(V-11)

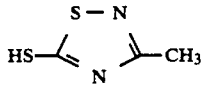

(V-12)

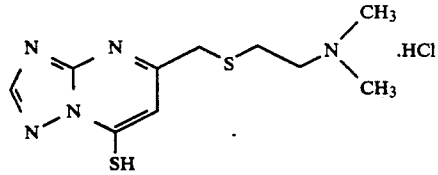

Diffusible 4-thiazoline-2-thione compounds referred to in (4) above for achieving the interimage effect are described in U.S. Pat. No. 3,536,487, and N- substituted 4-thiazoline-2-thione compounds referred to in (4) above for achieving the interimage effect are described in U.S. Pat. No. 3,723,125.

Silver halide emulsions containing surface-fogged silver halide grains referred to in (5) above for achieving the interimage effect are described in U.S. Pat. No. 4,082,553, and silver halide emulsions containing interior-fogged silver halide grains referred to in (6) above for achieving the interimage effect are described in U.S. Pat. No. 4,626,498.

The silver halide emulsions containing surface-fogged or interior fogged grains referred to in (5) or (6) mean silver halide emulsions which, when coated to form a photographic light-sensitive material, are capable of being developed uniformly (non imagewise) in both non-exposed areas and exposed areas.

The silver halide emulsion containing interior-fogged silver halide grains is an emulsion which comprises core/shell type silver halide grains each composed of a surface-fogged inner nucleus of silver halide grain and an outer shell of silver halide covering the surface of the inner nucleus, and which is scarcely developed in the initial stage of development but is developed in a proportion of 30% or more of the whole silver amount regardless of exposure or non exposure of the light-sensitive material in a color reversal development which contains sensitizing and desensitizing processings.

The silver halide emulsion containing surfacefogged grains may be prepared by adding a reducing agent or a gold salt to an emulsion capable of forming a surface latent image under conditions of proper pH and pAg, by heating the emulsion at a low pAg, or by uniformly exposing the emulsion. As the reducing agent, there may be used stannous chloride, hydrazine compounds, ethanolamine, etc.

Interior-fogged silver halide grains may be prepared by depositing silver halide on the surface of the above-described surface-fogged silver halide grains to form an outer shell.

Solution physical development may be adjusted in time with development by changing the thickness of the outer shell of the interior-fogged core/shell type silver halide grains.

The preferable thickness of the outer shell varies depending upon development processing, developing time, timing of developing each light-sensitive silver halide emulsion layer, etc., but is usually 30 to 1,000 Å, particularly preferably 50 to 500 Å which enables good results to be obtained.

The silver halide forming the inner nucleus of the interior fogged core/shell type silver halide grains and silver halide forming the outer shell may be the same or different from each other in halide composition.

As the interior or surface-fogged silver halide, any of silver chloride, silver chlorobromide, silver bromoiodide, silver chlorobromoiodide, etc. may be used.

These fogged silver halide grains are not particularly limited as to grain size, but the size is preferably 0.01 to 0.75 μm, particularly preferably 0.05 to 0.6 μm, in terms of average grain size.

Grain form is not particularly limited, either, and the emulsion, may be a polydisperse emulsion, with a monodisperse emulsion (wherein at least 95% by weight or number of the grains have grain size falling within ±40% of the average grain size) being preferable.

The silver halide emulsion referred to in (5) and (6) containing interior- or surface-fogged grains is added to at least one of the silver halide light-sensitive layer formed at the furthest position from the support and layers formed between the furthest layer and the support, and is preferably added to a silver halide light-sensitive layer.

Where two or more light-sensitive materials having the same color sensitivity and different sensitivities exist, the silver halide emulsion referred to in (5) and (6) is preferably added to a layer other than the most sensitive layer.

The amount of the silver halide emulsion containing interior- or surface-fogged silver halide grains to be used varies depending upon development processing conditions, development timing of an acceptive layer and a donative layer, etc., but is preferably 0.05 to 50 mol %, particularly preferably 0.1 to 40 mol %, based on the light-sensitive silver halide existing in the same or adjacent layer.

As to addition of colloidal silver described in (7) above for achieving the interimage effect, related descriptions are given in *Research Disclosure* (RD), No. 131, p. 13116, and the electron donor-releasing couplers described in (8) above for achieving the inerimage effect are described in JP-A-61-102646, JP-A-61-113060, U.S. Pat. No. 4,741,994, etc.

Various color couplers may be used in the present invention, and specific examples thereof are described in the patents described in the foregoing *Research Disclosure* (RD) No. 17643, VII-C to G.

As yellow couplers, those described in, for example, U.S. Pat. Nos. 3,933,501, 4,022,620, 4,326,024, 4,401,752, JP-B-58-10739, British Patent 1,425,020 and 1,476,760, etc. are preferable.

As magenta couplers, 5-pyrazolone type and pyrazoloazole type compounds are preferable, with those described in U.S. Pat. Nos. 4,310,619, 4,351,897, European Patent 73,636, U.S. Pat. Nos. 3,061,432, 3,725,067, *Research Disclosure,* No. 24220 (June 1984), JP-A-60-33552, *Research Disclosure,* No 24230 (June 1984), JP-A-60-43659, U.S. Pat. Nos. 4,500,630, 4,540,654, etc. being particularly preferable.

As cyan couplers there are illustrated phenolic and naphtholic couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German OLS No. 3,329,729, European Patent 121,365A, U.S. Pat. Nos. 3,446,622, 4,333,999, 4,451,559, 4,427,767, European Patent 161,626A, etc. are preferable. As colored couplers for correcting unnecessary absorption of colored dyes, those which are described in *Research Disclosure,* No. 17643, VII-G, U.S. Pat. No. 4,163,670, JP-B-57-39413, U.S. Pat. Nos. 4,004,929, 4,138,258, and British Patent 1,146,368 are preferable. As compounds capable of forming colored dyes with a suitable diffusibility, those which are described in U.S. Pat. No. 4,366,237, British Patent 2,125,570, European Patent 96,570, West German (OLS) No. 3,234,533, etc. are preferable.

Typical examples of polymerized dye-forming couplers are described in U.S. Pat. Nos. 3,451,820, 4,080,211, 4,367,282, British Patent 2,102,173, etc.

Couplers capable of releasing a photographically useful residue upon coupling reaction are also preferably used in the present invention. As DIR couplers capable of releasing a development inhibitor, those which are described in patents referred to in the foregoing RD 17643, VII F, JP A-57-151944, JP-A-57-154234, JP-A-60-184248, U.S. Pat. No. 4,248,962, etc. are preferable.

As couplers capable of imagewise releasing a nucleating agent or a development accelerator upon development, those which are described in British Patents 2,097,140, 2,131,188, JP-A-59-157638, JP-A-59-170840, etc. are preferable.

As further couplers to be used in the light-sensitive material of the present invention, there are illustrated competitive couplers described in U.S. Pat. No. 4,130,427, etc., polyequivalent couplers described in U.S. Pat. Nos. 4,283,472, 4,338,393, 4,310,618, etc., DIR redox compound-releasing couplers described in JP-A-60-185950, etc., couplers capable of recoloring after being released described in European Patent 173,302A and the like.

The couplers which can be used in the present invention may be introduced into light sensitive materials by various known dispersing processes.

Examples of high-boiling solvents which can be used in the oil-in-water dispersing process are described in U.S. Pat. No. 2,322,027, etc.

Steps and advantages of the latex dispersion process and specific examples of latex for impregnation are described in U.S. Pat. No. 4,199,363, West German (OLS) Nos. 2,541,274 and 2,541,230, etc.

Suitable supports which can be used in the present invention are described in, for example, the aforesaid

*Research Disclosure,* No. 17643, p. 28, and ibid., No. 18716, p. 647, right column to p. 648, left column.

As an exposure light source for light-sensitive materials in the present invention for prints such as color reversal duplication, color reversal paper and color paper among the color photographic light-sensitive materials of the present invention, a wavelength-transducing element comprising a non-linear optical material is preferably used.

That is, such an element enables exposure with a red light, a green light and a blue light having an extremely narrow wavelength region and reduces color mixing in light-sensitive materials for print, which serves to improve color reproducibility.

In conducting color reversal processing, usually a black-and-white development is conducted before color development.

The color reversal processing is generally conducted as set forth below:

1) 1st development→water wash→reversal→color development→adjusting→bleaching→fixing→water wash→stabilization;

2) 1st development→water wash→reversal43 color development→bleaching→bleach-fixing→water wash→stabilization;

3) 1st development→water wash→photofogging →color development→bleach-fixing→water wash→ stablization; or 4) prehardening→water wash→1st development →water wash→reversal→color development→stabilization.

All the 1st developments described above are black-and-white developments.

In this black-and-white developer, known black-and-white developing agents such a dihydroxybenzenes (e.g., hydroquinone), 3-pyrazolidones (e.g., 1-phenyl-3-pyrazolidone), aminophenols (e.g., N-methyl-p-amino phenol), etc. may be used alone or in combination.

The color developer to be used for developing the light-sensitive material in the present invention is preferably an alkaline aqueous solution containing an aromatic primary amine color developing agent as a major ingredient. As this color-developing agent, p-phenylenediamine compounds are preferably used, though aminophenolic compounds are also useful. Typical examples thereof include 3-methyl-4-amino N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethyl-N-8-methoxyethylaniline. sulfates, hydrochlorides or p toluenesulfonates thereof, etc. These compounds may be used in combination of two or more depending upon the purposes.

The color developer generally contains a pH buffer agent such as an alkali metal carbonate, borate or phosphate, a development inhibitor or antifoggant such as a bromide, an iodide, a benzimidazole, a benzothiazole or a mercapto compound. If necessary, to the color developer may be added various preservatives such as hydroxylamine, diethylhydroxylamine, hydrazine sulfites, phenylsemicarbazides, triethanolamine, catecholsulfonic acids, triethylenediamine (1,4-diazabicyclo(2,2,-2)octane), etc., an organic solvent such as ethylene glycol of diethylene glycol, a development accelerator such as benzyl alcohol, polyethylene glycol, a quaternary ammonium salt or an amine, a dye-forming coupler, a competitive coupler, a fogging agent such as sodium borohydride, an auxiliary developing agent such as 1-phenyl-3-pyrazolidone, a viscosity imparting agent, various chelating agents represented by aminopolycarboxylic acids, aminopolyphosphonic acids, alkyl phosphonic acids, and phosphonocarboxylic acids.

pH values of these black-and-white developers and color developers are generally 9 to 12.

Color-developed photographic emulsion layers are usually bleached. Bleaching may be conducted independently or simultaneously with fixing (bleach-fixing). In order to promote the processing, bleach-fixing may be conducted after bleaching. Further, processing in two continuous bleach-fixing baths, fixing before bleach-fixing, or bleaching after bleach-fixing may freely be conducted as the case demands. As bleaching agents, compounds of polyvalent metals such as iron(III), cobalt(III), chromium(VI), copper(II), etc., peracids, quinones, nitro compounds, etc. are used. As typical bleaching agents, ferricyanides; dichromates; organic complex salts of iron(III) or cobalt(III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc. or of organic acids such as citric acid, tartaric acid, malic acid, etc.; persulfates; bromic acid salts; permanganates; nitrobenzenes, etc. may be used.

The bleaching solution, bleach-fixing solution, and pre baths thereof may contain, if necessary, various bleaching accelerators. Specific examples of useful bleaching accelerators are described in the following specifications: U.S. Pat. No. 3,893,858, West German Patents 1,290,812 and 2,059,988, JP-A 53-32736, JP-A-53-57831, JP-A-53-37418, JP-A-53 72623, JP-A 53-95630, JP-A-53-95631, JP-A-53-104232, JP A-53-124424, JP A-53-141623, JP-A-53-28426, *Research Disclosure,* No. 17129 (July, 1978), etc.

These bleaching accelerators may be added to light-sensitive materials. These bleaching accelerators are particularly effective in the case of bleach-fixing color light-sensitive materials for photographing use.

As fixing agents, there are illustrated thiosulfates, thiocyanates, thioether compounds, thioureas, a large amount of iodide salts, etc., with the use of thiosulfates being popular. Ammonium thiosulfate is most widely usable. As preservatives for the bleach-fixing solution, sulfites, bisulfites, or carbonylbisulfurous acid adducts are preferable.

The silver halide color photographic material in the present invention is generally subjected to a water-washing step and/or a stabilizing step after removal of silver. The amount of water to be used in the water-washing step may be selected from a wide range depending upon various factors such as properties of light-sensitive materials (resulting from, for example, used materials such as couplers), end-use, temperature of washing water, number (stage number) of water washing tanks, replenishing manner (counter current or co-current), and the like. Of these, relation between the number of washing tanks and amount of water in multi-stage countercurrent washing can be determined according to the method described in "Journal of the Society of Motion Picture and Television Engineers", vol. 64, pp. 248 to 253 (May, 1955).

The present invention is now illustrated in more detail by reference to the following examples which, however, are not to be construed as limiting the present invention in any way.

EXAMPLE 1

A multi-layer color light sensitive material, Sample 101, comprising a subbed, 135-μ thick cellulose triacetate film having provided thereon layers of the following formulations was prepared. The amounts denote the coated amount. For the silver halide emulsion, the amounts denote the coated amount calculated as silver.

| | |
|---|---|
| **1st layer: antihalation layer** | |
| Gelatin layer (dry thickness: 2μ) containing: | |
| Black colloidal silver | 0.25 g/m$^2$ |
| UV ray absorbent U-1 | 0.04 g/m$^2$ |
| UV ray absorbent U-2 | 0.1 g/m$^2$ |
| UV ray absorbent U-3 | 0.1 g/m$^2$ |
| High-boiling organic solvent O-1 | 0.1 cc/m$^2$ |
| **2nd layer: interlayer** | |
| Gelatin layer (dry thickness: 1μ) containing: | |
| Compound H-1 | 0.05 g/m$^2$ |
| High-boiling organic solvent O-2 | 0.05 cc/m$^2$ |
| Compound A-2 | 0.16 g/m$^2$ |
| **3rd layer: first red-sensitive emulsion layer** | |
| Gelatin layer (dry thickness: 0.7μ) containing: | |
| Mono-disperse AgBrI emulsion spectrally sensitized with sensitizing dye II-1 (0.93 mg/m$^2$) and sensitizing dye III-1 (0.04 mg/m$^2$) (iodide content: 6 mol %; average grain size: 0.45μ; variation coefficient with grain size (hereinafter merely abbreviated as variation coefficient): 19%) | 0.33 g of Ag/m$^2$ |
| Coupler C-1 | 0.13 g/m$^2$ |
| Coupler C-2 | 0.033 g/m$^2$ |
| High-boiling organic solvent O-2 | 0.08 cc/m$^2$ |
| **4th layer: second red-sensitive emulsion layer** | |
| Gelatin layer (dry thickness: 1.7μ) containing: | |
| Mono-disperse AgBrI emulsion spectrally sensitized with sensitizing dye II-1 (1.1 mg/m$^2$) and sensitizing dye III-1 (0.04 mg/m$^2$) (iodide content: 6 mol %; average grain size: 0.60μ; variation coefficient: 16%) | 0.53 g of Ag/m$^2$ |
| Compound A-4 | 0.02 mg/m$^2$ |
| Coupler C-1 | 0.40 g/m$^2$ |
| Coupler C-2 | 0.07 g/m$^2$ |
| High-boiling organic solvent O-2 | 0.22 cc/m$^2$ |
| **5th layer: third red-sensitive emulsion layer** | |
| Gelatin layer (dry thickness: 1.8μ) containing: | |
| Mono-disperse AgBrI emulsion spectrally sensitized with sensitizing dye II-1 (1.1 mg/m$^2$) and sensitizing dye III-1 (0.04 mg/m$^2$) (iodide content: 6 mol %; average grain size: 0.80μ; variation coefficient: 17%) | 0.53 g of Ag/m$^2$ |
| Compound A-7 | 0.5 mg/m$^2$ |
| Coupler C-6 | 0.44 g/m$^2$ |
| Coupler C-2 | 0.08 g/m$^2$ |
| High-boiling organic solvent O-2 | 0.24 cc/m$^2$ |
| **6th layer: interlayer** | |
| Gelatin layer (dry thickness: 1μ) containing: | |
| Compound A-10 | 10 mg/m$^2$ |
| Compound A-11 | 5 mg/m$^2$ |
| Compound H-1 | 0.1 g/m$^2$ |
| High-boiling organic solvent O-2 | 0.1 cc/m$^2$ |
| Compound A-2 | 0.2 g/m$^2$ |
| **7th layer: first green-sensitive emulsion layer** | |
| Gelatin layer (dry thickness: 0.7μ) containing: | |
| Mono-disperse AgBrI emulsion spectrally sensitized with sensitizing dye S-3 (2.2 mg/m$^2$) and sensitizing dye S-4 (1.0 mg/m$^2$) (iodide content: 6 mol %; average grain size: 0.45μ; variation coefficient: 19%) | 0.5 g of Ag/m$^2$ |
| Compound A-5 | 0.12 mg/m$^2$ |
| coupler C-3 | 0.27 g/m$^2$ |
| High-boiling organic solvent O-2 | 0.17 cc/m$^2$ |
| **8th layer: second green-sensitive emulsion layer** | |
| Gelatin layer (dry thickness: 1.7μ) containing: | |
| Mono-disperse AgBrI emulsion spectrally sensitized with sensitizing dye S-3 (0.9 mg/m$^2$) and sensitizing dye S-4 (0.3 mg/m$^2$) (iodide content: 6 mol %; average grain size: 0.65μ; variation coefficient: 18%) | 0.5 g of Ag/m$^2$ |
| Compound A-6 | 0.05 mg/m$^2$ |
| Coupler C-3 | 0.2 g/m$^2$ |
| High-boiling organic solvent O-2 | 0.13 cc/m$^2$ |
| **9th layer: third green-sensitive emulsion layer** | |
| Gelatin layer (dry thickness: 1.7μ) containing: | |
| Mono-disperse AgBrI emulsion spectrally sensitized with sensitizing dye S-3 (0.9 mg/m$^2$) and spectrally sensitizing dye S-4 (0.3 mg/m$^2$) (iodide content: 6 mol %; average grain size: 0.8μ; variation coefficient: 17%) | 0.5 g of Ag/m$^2$ |
| Coupler C-4 | 0.2 g/m$^2$ |
| Coupler C-3 | 0.1 g/m$^2$ |
| High-boiling organic solvent O-2 | 0.03 cc/m$^2$ |
| **10th layer: interlayer** | |
| Gelatin layer (dry thickness: 1μ) containing: | |
| Compound A-12 | 10 mg/m$^2$ |
| Compound H-1 | 0.05 g/m$^2$ |
| High-boiling organic solvent O-2 | 0.1 g/m$^2$ |
| **11th layer: yellow filter layer** | |
| Gelatin layer (dry thickness: 1μ) containing: | |
| Compound A-1 | 0.15 g/m$^2$ |
| Yellow colloidal silver | 0.05 g/m$^2$ |
| Compound H-1 | 0.02 g/m$^2$ |
| Compound H-2 | 0.03 g/m$^2$ |
| High-boiling organic solvent O-2 | 0.04 cc/m$^2$ |
| **12th layer: first blue-sensitive emulsion layer** | |
| Gelatin layer (dry thickness: 1.5μ) containing: | |
| Tabular AgBrI emulsion spectrally sensitized with sensitizing dye S-5 (1.0 mg/m$^2$) (iodide content: 6 mol %; grains of 7 or more in diameter/thickness ratio accounting for 50% of the projected area of the whole grains; average thickness of grains: 0.15μ) | 0.6 g of Ag/m$^2$ |
| Compound A-7 | 0.5 g/m$^2$ |
| Coupler C-5 | 0.5 g/m$^2$ |
| High-boiling organic solvent O-2 | 0.1 cc/m$^2$ |
| **13th layer: second blue-sensitive emulsion layer** | |
| Gelatin layer (dry thickness: 3μ) containing: | |
| Tabular AgBrI emulsion spectrally sensitized with sensitizing dye S-5 (2.0 mg/m$^2$) (iodide content: 6 mol %; grains of 7 or more in diameter/thickness ratio accounting for 50% of the projected area of the whole grains; average thickness of grains: 0.25μ) | 1.1 g of Ag/m$^2$ |
| Coupler C-7 | 1.2 g/m$^2$ |
| Coupler C-8 | 0.2 g/m$^2$ |
| High-boiling organic solvent O-2 | 0.23 cc/m$^2$ |
| **14th layer: first protective layer** | |
| Gelatin layer (dry thickness: 2μ) containing: | |
| Compound A-13 | 0.10 g/m$^2$ |
| Ultraviolet ray absorbent U-1 | 0.02 g/m$^2$ |
| Ultraviolet ray absorbent U-2 | 0.03 g/m$^2$ |
| Ultraviolet ray absorbent U-3 | 0.03 g/m$^2$ |

-continued

| | | |
|---|---|---|
| Ultraviolet ray absorbent U-4 | 0.29 | $g/m^2$ |
| Coupler C-1 | 0.05 | $g/m^2$ |
| High-boiling organic solvent O-1 | 0.28 | $cc/m^2$ |
| 15th layer: second protective layer | | |
| Gelatin layer (dry thickness: 0.8μ) containing: | | |
| AgBrI emulsion containing surface-fogged fine grains (iodide content: 1 mol %, average grain size: 0.06μ) | 0.1 | $g/m^2$ |
| Yellow colloidal silver for yellow filter layer | 0.01 | g of $Ag/m^2$ |

-continued

| | | |
|---|---|---|
| Compound A-8 | 10 | $mg/m^2$ |
| Polymethyl methacrylate particles (average size: 1.5μ) | 0.1 | $g/m^2$ |
| Compound A-9 | 1.0 | $mg/m^2$ |
| Compound A-14 | 0.1 | $g/m^2$ |

To each layer were added an antifoggant A-3, a gelatin hardener H-3, and a surfactant.

Compounds used for preparing the sample are shown below.

C-1

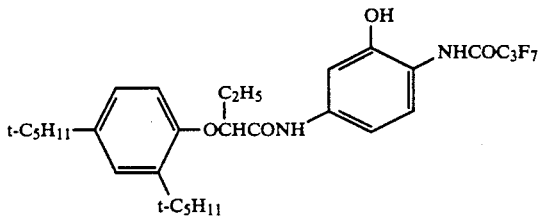

C-2

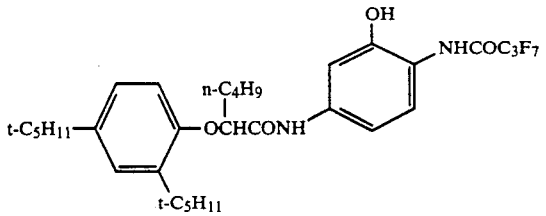

C-3

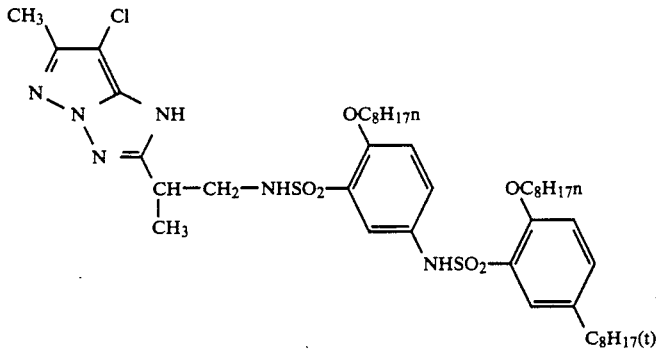

C-4

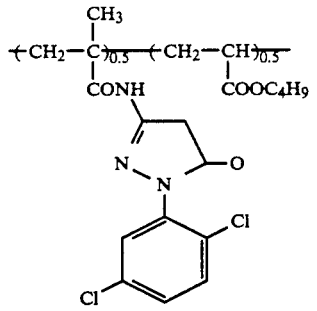

C-5

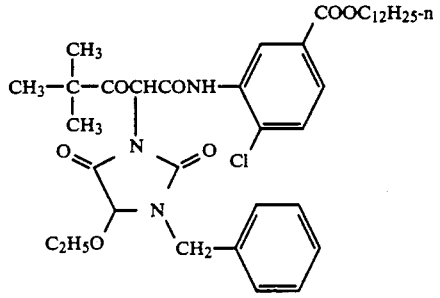

-continued
C-6
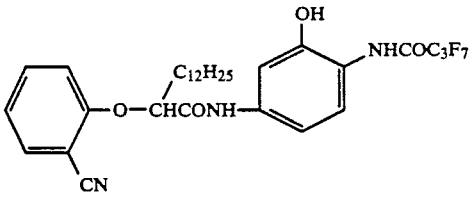
C-7
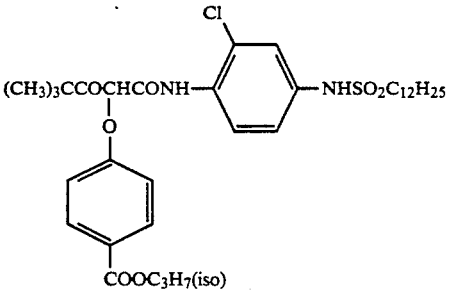
C-8
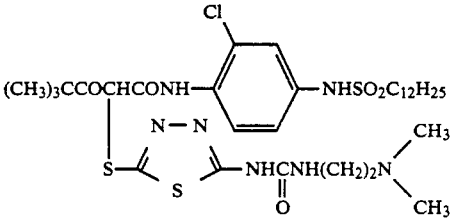
U-1
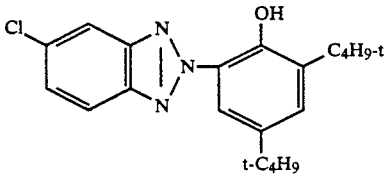
U-2
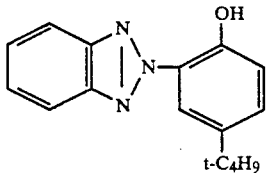
U-3
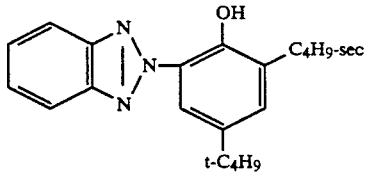
U-4
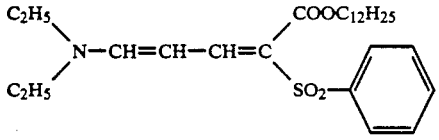
H-1
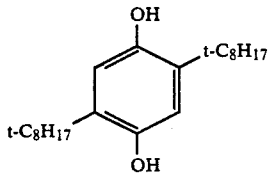

-continued
H-2
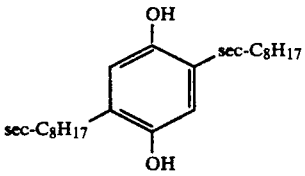
H-3
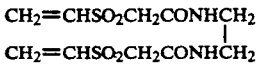
O-1
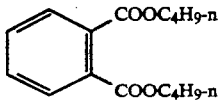
O-2
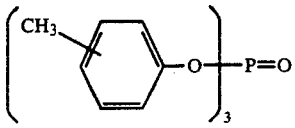
S-1
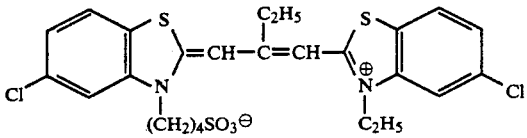
S-2
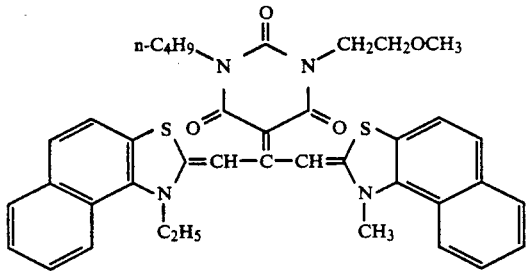
S-3
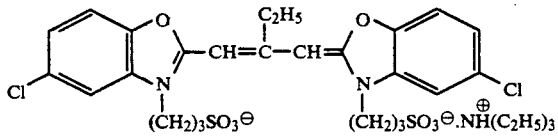
S-4
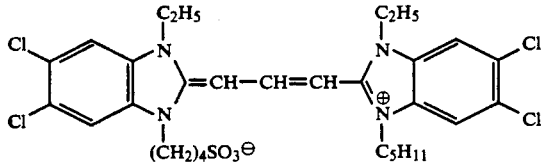
S-5
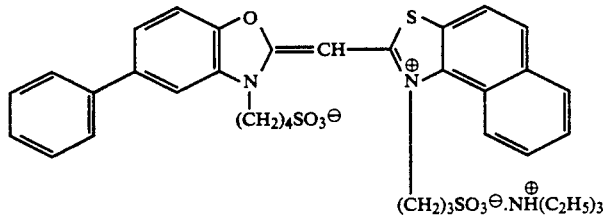
A-1
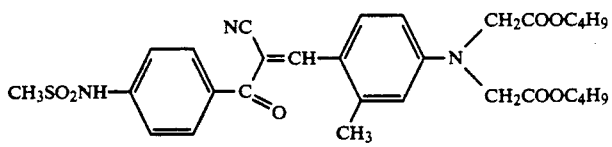

-continued
A-2
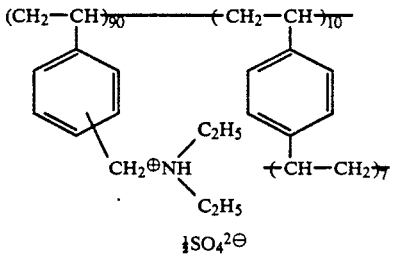
A-3
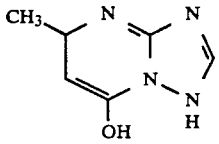
A-4
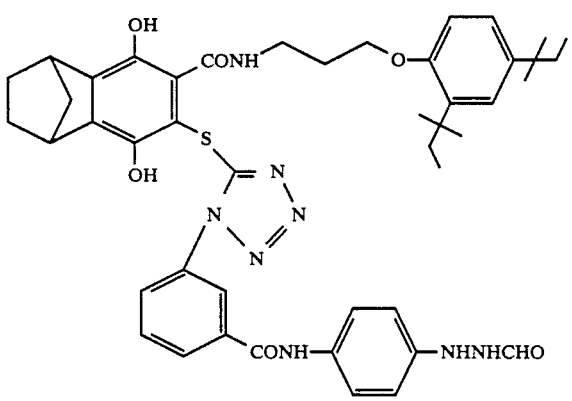
A-5
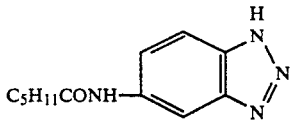
A-6
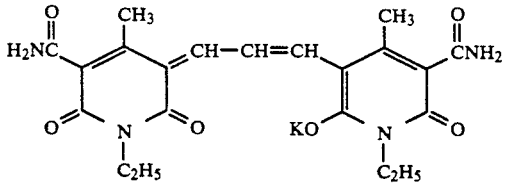
A-7
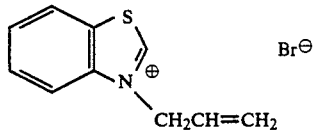
A-8
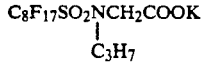
A-9
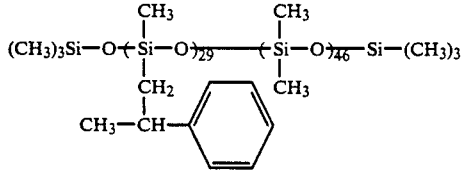

-continued

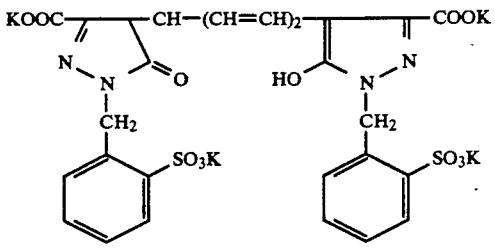

A-10

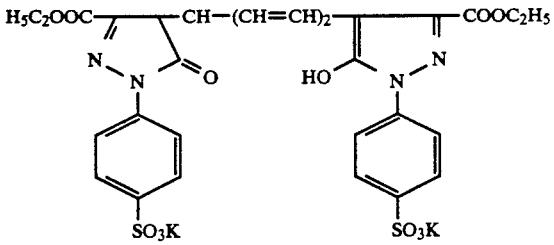

A-11

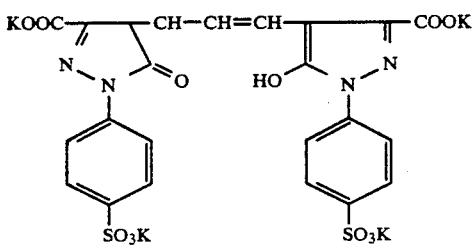

A-12

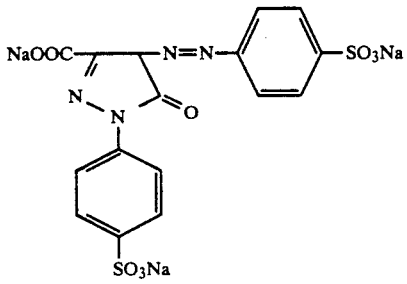

A-13

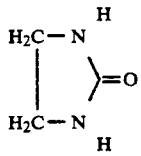

A-14

Preparation of Samples 102 to 104

Samples 102 to 104 were prepared in absolutely the same manner as with Sample 101 except for changing sensitizing dyes used in the 3rd, 4th and 5th layers of Sample 101, to compounds shown in Table 1.

Preparation of Samples 105 to 108:

Samples 105 to 108 were prepared in absolutely the same manner as with Samples 101 to 104, respectively, except for changing the silver iodide content of the silver halide grains in the 3rd, 4th, 5th, 7th, 8th, 9th, 12th and 13th layers of Samples 101 to 104, to 3.7 mol %, 4.5 mol %, 5.0 mol %, 3.5 mol %, 4.5 mol %, 5.5 mol %, 3.6 mol %, and 5.0 mol %, respectively.

Preparation of Samples 109

Sample 109 was prepared in absolutely the same manner as with Sample 108, except for changing the silver iodide content of the silver halide grains in the 3rd, 4th, 5th, 7th, 8th, 9th, 12th and 13th layers of Sample 108, to 4 mol %, 3 mol %, 2 mol %, 4 mol %, 3 mol %, 2 mol %, 3 mol % and 2.5 mol %, respectively.

The thus prepared Samples 101 to 109 were exposed to an ISO daylight illuminant described in JIS K 7602, p. 5 through a continuous wedge, then subjected to the following development processing to measure density. ISO speeds were determined according to the method described in JIS K 7613, pp. 3 to 4.

As a result, Samples 101 to 109 were found to have a speed of ISO 400.

Then, ospenergy spectral sensitivity distribution was determined according to the method described in JIS Z 8105-2018.

Figure 2:
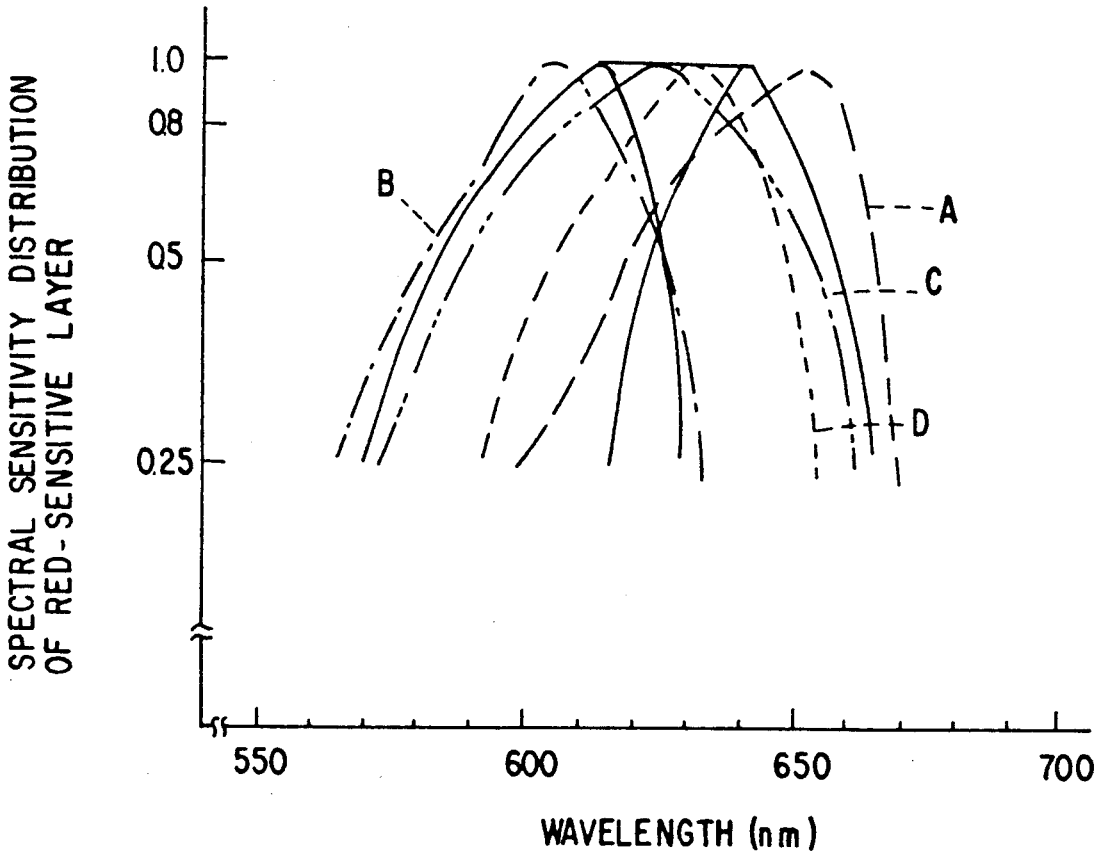
FIG. 2 shows a spectral sensitivity distribution of the red-sensitive layer of a light-sensitive material obtained in Example 1 of the present invention.

Results thus obtained are shown in FIG. 2 and Table 1.

The interimage effect to the red-sensitive silver halide emulsion layer, green-sensitive silver halide emulsion layer and blue-sensitive silver halide emulsion layer was determined as follows.

Samples 101 to 109 were exposed to red light through a continuous wedge, then subjected to the following development processing. Separately, Samples 101 to 109 were exposed through a continuous wedge to white light (red light +green light +blue light) with adjusting the three color lights so that the samples gave a gray color after development processing, and subjected to the same development processing. Additionally, the exposure amount of red light employed for the red-light exposure was the same as that of the red light for the white-light exposure.

Densities of the development processed samples were measured, and difference in exposure amount, log E (R), between the amount of red light exposure and the exposure amount of the white light giving a cyan density of 1.0 was determined as a value showing an interimage effect to the red-sensitive silver halide emulsion layer.

Interimage effects to the green-sensitive silver halide emulsion layer and blue-sensitive silver halide emulsion layer were determined in the same manner.

The results thus obtained are tabulated in Table 2.

Then, Samples 101 to 109 were cut into 135-size pieces, and Macbeth color chart was photographed using them under daylight, followed by development processing of them to visually compare color reproducibility.

Likewise, Macbeth color chart was photographed using them with changing the illumination to a mercury lamp, and color reproducibility was compared as to the above-described samples photographed under daylight.

Results thus obtained are shown in Table 3.

| Processing step | Time | Temperature |
|---|---|---|
| First development | 6 min | 38° C. |
| Washing with water | 2 min | 38° C. |
| Reversing | 2 min | 38° C. |
| Color development | 6 min | 38° C. |
| Adjustment | 2 min | 38° C. |
| Bleaching | 6 min | 38° C. |
| Fixing | 4 min | 38° C. |
| Washing with water | 4 min | 38° C. |
| Stabilizing | 1 min | 25° C. |

Formulations of the respective processing solutions were as follows.

| First developer | |
|---|---|
| 5 Sodium nitrilo-N,N,N-trimethylene-phosphonate | 2.0 g |
| Sodium sulfite | 30 g |
| Hydroquinone monosulfonic acid potassium salt | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

pH was adjusted with hydrochloric acid or potassium hydroxide.

| Reversing solution | |
|---|---|
| 5 Sodium nitrilo-N,N,N-trimethylene-phosphonate | 3.0 g |
| Stannous chloride 2 hydrate | 1.0 g |
| p-Aminophenol | 0.1 g |
| Sodium hydroxide | 8 g |
| Glacial acetic acid | 15 ml |
| Water to make | 1000 ml |
| pH | 6.00 |

pH was adjusted with hydrochloric acid or sodium hydroxide.

| Color developer | |
|---|---|
| 5 Sodium nitrilo-N,N,N-trimethylene-phosphonate | 2.0 g |
| Sodium sulfite | 7.0 g |
| Trisodium phosphate 12 hydrate | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamido-ethyl)-3-methyl-4-aminoaniline sulfate | 11 g |
| 3,6-Dithiaoctane-1,8-diol | 1.0 g |
| Water to make | 1000 ml |
| pH | 11.80 |

pH was adjusted with hydrochloric acid or potassium hydroxide.

| Adjusting solution | |
|---|---|
| Disodium ethylenediaminetetraacetate dihydrate | 8.0 g |
| Sodium sulfite | 12 g |
| 1-Thioglycerin | 0.4 ml |
| Water to make | 1000 ml |
| pH | 6.20 |

pH was adjusted with hydrochloric acid or sodium hydroxide.

| Bleaching solution | |
|---|---|
| Disodium ethylenediaminetetraacetate dihydrate | 2.0 g |
| Fe(III) ammonium ethylenediamine-tetraacetate dihydrate | 120 g |
| Potassium bromide | 100 g |
| Ammonium nitrate | 10 g |
| Water to make | 1000 ml |
| pH | 5.70 |

pH was adjusted with hydrochloric acid or sodium hydroxide.

| Fixing solution | |
|---|---|
| Sodium thiosulfate | 80 g |
| Sodium sulfite | 5.0 g |
| Sodium bisulfite | 5.0 g |
| Water to make | 1000 ml |
| pH | 6.60 |

pH was adjusted with hydrochloric acid or aqueous ammonia.

| Stabilizing solution | |
|---|---|
| Formalin (37%) | 5.0 ml |

-continued

| Stabilizing solution | |
|---|---|
| Polyoxyethylene-p-monononyl-phenyl ether (average polymerization degree: 10) | 0.5 ml |
| Water to make | 1000 ml |
| pH | not adjusted |

The above described Samples 101 to 117 were subjected to the following accelerated reversal processing and evaluating the photographic properties in the same manner and the same results as shown in Tables 1 and 2 were obtained.

| Processing step | Time | Temperature |
|---|---|---|
| First development | 6 min | 38° C. |
| First washing with water | 45 sec | 38° C. |
| Reversing | 45 sec | 38° C. |
| Color development | 6 min | 38° C. |
| Bleaching | 2 min | 38° C. |
| Bleach-fixing | 4 min | 38° C. |
| Second washing with water (First tank) | 1 min | 38° C. |
| Second washing with water (Second tank) | 1 min | 38° C. |
| Stabilizing | 1 min | 25° C. |

Formulations of respective processing solutions were as follows.

| First developer | |
|---|---|
| 5 Sodium nitrilo-N,N,N-trimethylene-phosphonate | 2.0 g |
| Sodium sulfite | 30 g |
| potassium hydroquinonemonosulfate | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water to make | 1000 ml |
| pH | 9.60 |

pH was adjusted with hydrochloric acid or potassium hydroxide.

| First Washing water solution | Mother liquor |
|---|---|
| Ethylenediaminetetramethylene-phosphonic acid | 2.0 g |
| Disodium phosphate | 5.0 g |
| Water to make | 1000 ml |
| pH | 7.00 |

pH was adjusted with hydrochloric acid or sodium hydroxide.

| Reversing solution | |
|---|---|
| 5 Sodium nitrilo-N,N,N-trimethylene-phosphonate | 3.0 g |

-continued

| Reversing solution | |
|---|---|
| Stannous chloride dihydrate | 1.0 g |
| p-Aminophenol | 0.1 g |
| Sodium hydroxide | 8 g |
| Glacial acetic acid | 15 ml |
| Water to make | 1000 ml |
| pH | 6.00 |

pH was adjusted with hydrochloric acid or sodium hydroxide.

| Color developer | |
|---|---|
| 5 Sodium nitrilo-N,N,N-trimethylene-phosphonate | 2.0 g |
| Sodium sulfite | 7.0 g |
| Trisodium phosphate 12 hydrate | 36 g |
| Potassium bromide | 1.0 g |
| Potassium iodide | 90 mg |
| Sodium hydroxide | 3.0 g |
| Citrazinic acid | 1.5 g |
| N-Ethyl-N-(β-methanesulfonamide-ethyl)-3-methyl-4-aminoaniline sulfate | 11 g |
| 3,6-Dithiaoctane-1,8-diol | 1.0 g |
| Water to make | 1000 ml |
| pH | 11.80 |

pH was adjusted with hydrochloric acid or potassium hydroxide.

| Bleaching solution | |
|---|---|
| Disodium ethylenediaminetetra-acetate dihydrate | 10.0 g |
| Fe(III) ammonium ethylene-diaminetetraacetate dihydrate | 120 g |
| Ammonium bromide | 100 g |
| Ammonium nitrate | 10 g |
| Bleaching accelerator | 0.005 mol |

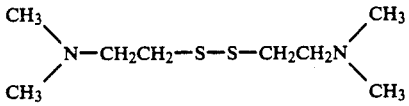

.2HCl

| | |
|---|---|
| Water to make | 1000 ml |
| pH | 6.30 |

pH was adjusted with hydrochloric acid or aqueous ammonia.

| Bleach-fixinq solution | |
|---|---|
| Fe(III) ammonium ethylene-diaminetetraacetate dihydrate | 50 g |
| Disodium ethylenediaminetetraacetate dihydrate | 5.0 g |
| Sodium thiosulfate | 80 g |
| Sodium sulfite | 12 0 g |
| Water to make | 1000 ml |
| pH | 6.60 |

pH was adjusted with hydrochloric acid or aqueous ammonia.

TABLE 1

| Sample No. | Sensitizing Dye 3rd Layer | | Sensitizing Dye 4th Layer | | Sensitizing Dye 5th Layer | | Spectral Sensitivity (FIG. 2) | Maximum Speed Wavelength (nm) | Wavelength Region of 25% Speed of Maximum Speed (nm) |
|---|---|---|---|---|---|---|---|---|---|
| 101 (Comparison) | II-1 | 0.93 mg/m² | II-1 | 1.1 mg/m² | II-1 | 1.1 mg/m² | | | |

TABLE 1-continued

| Sample No. | Sensitizing Dye 3rd Layer | | 4th Layer | | 5th Layer | | Spectral Sensitivity (FIG. 2) | Maximum Speed Wavelength (nm) | Wavelength Region of 25% Speed of Maximum Speed (nm) |
|---|---|---|---|---|---|---|---|---|---|
| and 105 (Comparison) | III-1 | 0.04 mg/m$^2$ | III-1 | 0.04 mg/m$^2$ | III-1 | 0.04 mg/m$^2$ | A | 650 | 70 |
| 102 (Comparison) | I-4 | 0.75 mg/m$^2$ | I-4 | 0.85 mg/m$^2$ | I-4 | 0.85 mg/m$^2$ | | | |
| and 106 (Comparison) | II-1 | 0.15 mg/m$^2$ | II-1 | 0.17 mg/m$^2$ | II-1 | 0.17 mg/m$^2$ | B | 605 | 72 |
| 103 (Comparison) | I-4 | 0.20 mg/m$^2$ | I-4 | 0.24 mg/m$^2$ | I-4 | 0.24 mg/m$^2$ | | | |
| and 107 (Comparison) | I-3<br>II-1<br>II-10 | 0.35 mg/m$^2$<br>0.30 mg/m$^2$<br>0.20 mg/m$^2$ | I-3<br>II-1<br>II-10 | 0.40 mg/m$^2$<br>0.35 mg/m$^2$<br>0.24 mg/m$^2$ | I-3<br>II-1<br>II-10 | 0.40 mg/m$^2$<br>0.35 mg/m$^2$<br>0.24 mg/m$^2$ | C | 625 | 94 |
| 104 (Comparison) | I-3 | 0.15 mg/m$^3$ | I-3 | 0.18 mg/m$^2$ | I-3 | 0.18 mg/m$^2$ | | | |
| 108 (Invention) and 109 (Invention) | II-1<br>III-1 | 0.75 mg/m$^2$<br>0.04 mg/m$^2$ | II-1<br>III-1 | 0.90 mg/m$^2$<br>0.05 mg/m$^2$ | II-1<br>III-1 | 0.90 mg/m$^2$<br>0.05 mg/m$^2$ | D | 630 | 63 |

Second washing solution

City water was passed through a mixed-bed column packed with H-type strongly acidic cation-exchange resin (Amberlite IR-120B; made by Rohm & Haas Co.) and OH-type anion-exchange resin (Amberlite IR-400; made by Rohm & Haas Co.) to decrease the concentrations of calcium and magnesium ions to 3 mg/liter or less, then 20 mg/litter of sodium dichloroisocyanurate and 1.5 g/liter of sodium sulfate were added thereto. This solution had a pH of 6.5 to 7.5.

| Stabilizing solution | |
|---|---|
| Formalin (37%) | 5.0 ml |
| Polyoxyethylene p-monononylphenyl ether (average polymerization degree: 10) | 0.5 ml |
| Water to make | 1000 ml |
| pH | not adjusted |

TABLE 2

| Sample No. | Average AgI Content of Whole Light-Sensitive Emulsion (mol %) | ΔlogE (R) | ΔlogE (G) | ΔlogE (B) |
|---|---|---|---|---|
| 101 (Comparison) | 6.0 | 0.06 | 0.05 | 0.03 |
| 102 (Comparison) | " | 0.05 | 0.05 | 0.03 |
| 103 (Comparison) | " | 0.06 | 0.06 | 0.04 |
| 104 (Comparison) | " | 0.05 | 0.05 | 0.04 |
| 105 (Comparison) | 4.5 | 0.16 | 0.15 | 0.13 |
| 106 (Comparison) | " | 0.15 | 0.14 | 0.12 |
| 107 (Comparison) | " | 0.15 | 0.14 | 0.13 |
| 108 (Invention) | " | 0.16 | 0.15 | 0.14 |
| 109 (Invention) | 2.8 | 0.22 | 0.21 | 0.19 |

TABLE 3

| Sample No. | Color Reproducibility in Photographing under Daylight: Saturation | Hue | Difference in Color Reproducibility between Photographing under Daylight and Photographing under Mercury Lamp Light (Difference in color balance) |
|---|---|---|---|
| 101 (Comparison) | Δ | O | Δ |
| 102 (Comparison) | x | x | O |
| 103 (Comparison) | x | Δ | Δ |
| 104 (Comparison) | x | O | Δ |
| 105 (Comparison) | O | O | x |
| 106 (Comparison) | Δ | x | O |
| 107 (Comparison) | O | Δ | O |
| 108 (Invention) | O | O | O |

TABLE 3-continued

| Sample No. | Color Reproducibility in Photographing under Daylight | | Difference in Color Reproducibility between Photographing under Daylight and Photographing under Mercury Lamp Light (Difference in color balance) |
|---|---|---|---|
| | Saturation | Hue | |
| 109 (Invention) | | | |

Saturation:
◎: extremely high
○: high
x: low
Δ: slightly low
Hue:
○: with good fidelity to an object
x: with poor fidelity to an object
Δ: with slightly poor fidelity to an object
Color balance:
○: small difference in color balance
x: large difference in color balance
Δ: slightly large difference in color balance It is seen from the results shown in Table 3 that, in comparison with the comparative samples, samples of the present invention are excellent in the points of color reproducibility under daylight photographing and difference in color reproducibility between daylight photographing and photographing under mercury lamp light.

EXAMPLE 2

Preparation of Sample 201 to 210

Samples 201 to 210 were prepared in absolutely the same manner as with Sample 109 except for adding compounds as shown in Table 4 below.

ISO speeds of these Samples 201 to 210 were determined in the same manner as in Example 1, and were confirmed to be ISO 400.

Separately, interimage effects to red-sensitive silver halide emulsion layer, green-sensitive silver halide emulsion layer and blue-sensitive silver halide emulsion layer in Samples 201 to 210 were determined in the same manner as in Example 1 to obtain the results shown in Table 5.

Macbeth chart was photographed using each of the samples under daylight and fluorescent lamp light in the same manner as in Example 1 to visually compare color reproducibility of the samples. The results are tabulated in Table 5.

Emulsions A and B

A silver bromide emulsion containing cubic grains of 0.15 μ in average grain size was prepared according to the controlled double jet process, and fogged with hydrazine and a gold complex salt at a low pAg (Emulsion B). Silver bromide was deposited on the surface of grains of the thus-prepared emulsion B in a thickness of 250 Å to form a shell around the grains. This emulsion was referred to as emulsion A.

Compound A

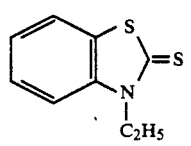

Compound B

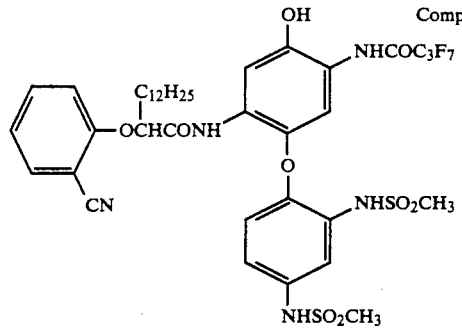

TABLE 4

| Sample No. | Added Compound | Added Compound | Added Compound |
|---|---|---|---|
| 109 | — | — | — |
| 201 | 5 mg/m$^2$ of IV-1 in each of 1st, 4th, 6th, 7th, 11th and 13th layers | 5 mg/m$^2$ of IV-3 in each of 3rd and 8th layers | 7 mg/m$^2$ of IV-4 in each of 5th, 9th and 12th layers |
| 202 | 0.8 mg/m$^2$ of V-1 in each of 3rd, 4th and 8th layers | 0.8 mg/m$^2$ of V-4 in each of 7th, 9th and 12th layers | 2 mg/m$^2$ of V-9 in each of 5th, 6th, 9th and 13th layers |
| 203 | 0.1 g of Ag/m$^2$ of emulsion A in each of 2nd, 3rd, 4th 6th and 7th layers | 0.05 g of Ag/m$^2$ of emulsion A in each of 5th, 8th and 12th layers | — |
| 204 | 0.01 g of Ag/m$^2$ of yellow colloidal silver in each of 2nd and 7th layers | 0.04 g of Ag/m$^2$ of emulsion B in each of 3rd, 7th and 8th layers | 0.05 g of Ag/m$^2$ of emulsion A in each of 12th and 13th layers |
| 205 | 0.01 g/m$^2$ of compound B in each of 3rd, 4th and 5th layers | 0.005 g/m$^2$ of compound B in each of 7th, 8th, 12th and 13th layers | 0.07 g of Ag/m$^2$ of emulsion A in each of 2nd, 6th and 7th layers |
| 206 | 0.05 g of Ag/m$^2$ of emulsion A in each of 3rd, 7th and 12th layers | 0.8 mg/m$^2$ of V-1 in each of 3rd, 4th, 7th, 8th and 12th layers | 0.5 mg/m$^2$ of V-9 in 5th, 8th 9th, 12th and 13th layers |
| 207 | 0.05 g of Ag/m$^2$ of emulsion B in each of 2nd and 6th | 0.03 g/m$^2$ of IV-1 in each of 3rd, 7th, 8th, 12th and | 10 mg/m$^2$ of V-10 in each of 3rd, 4th, 7th, 8th, 9th and |

TABLE 4-continued

| Sample No. | Added Compound | Added Compound | Added Compound |
|---|---|---|---|
| | layers | 13th layers | 12th layers |
| 208 | 0.05 g/m$^2$ of compound B in each of 2nd, 3rd, 6th, 8th and 12th layers | 0.05 g of Ag/m$^2$ of emulsion A in each of 3rd, 7th and 12th layers | 1 mg/m$^2$ of V-10 in each of 3rd, 4th, 7th, 8th and 12th layers |
| 209 | 1 mg/m$^2$ of compound C in each of 3rd, 4th, 7th and 8th layers | 0.8 mg/m$^2$ of V-12 in each of 3rd, 7th, 8th and 12th layers | 0.01 mg/m$^2$ of compound B in each of 4th, 5th, 9th and 13th layers |
| 210 | 0.08 mg/m$^2$ of V-11 in each of 3rd and 4th layers | 1.2 mg/m$^2$ of compound B in each of 3rd, 7th, 8th and 13th layers | 1.5 mg/m$^2$ of V-9 in each of 11th, 12th and 13th layers |

TABLE 5

| Sample No. | ΔlogE(R) | ΔlogE(G) | ΔlogE(B) | Color Reproducibility in Photographing under Daylight: Saturation | Color Reproducibility in Photographing under Daylight: Hue | Difference in Color Reproducibility Between Photographing under Daylight and Photographing under Mercury Lamp Light (Difference in Color Balance) |
|---|---|---|---|---|---|---|
| 109 (Invention) | 0.22 | 0.21 | 0.19 | ○ | ○ | ○ |
| 201 (Invention) | 0.27 | 0.27 | 0.23 | ◎ | ○ | ○ |
| 202 (Invention) | 0.31 | 0.30 | 0.27 | ◎ | ○ | ○ |
| 203 (Invention) | 0.27 | 0.28 | 0.25 | ◎ | ○ | ○ |
| 204 (Invention) | 0.25 | 0.26 | 0.26 | ◎ | ○ | ○ |
| 205 (Invention) | 0.28 | 0.27 | 0.27 | ◎ | ○ | ○ |
| 206 (Invention) | 0.34 | 0.33 | 0.25 | ◎ | ○ | ○ |
| 207 (Invention) | 0.27 | 0.31 | 0.24 | ◎ | ○ | ○ |
| 208 (Invention) | 0.32 | 0.32 | 0.28 | ◎ | ○ | ○ |
| 209 (Invention) | 0.27 | 0.29 | 0.24 | ◎ | ○ | ○ |
| 210 (Invention) | 0.36 | 0.32 | 0.32 | ◎ | ○ | ○ |

Saturation:
◎: extremely high
○: high
Hue:
○: with good fidelity to an object
Color balance:
○: small difference in color balance It is seen from the results shown in Table 5 that saturation can be markedly improved by employing the interimage-providing means of the present invention.

EXAMPLE 3

Preparation of Samples 301 to 308

Samples 301 to 304 were prepared in absolutely the same manner as with Samples 104, 108 and 109 in Example 1 and Sample 206 in Example 2 except for changing the grain size of the light-sensitive silver halide grains in the 3rd, 4th, 5th, 7th, 8th, 9th, 12th and 13th layers of Samples 104, 108, 109 and 206 to 1/1.59 times of that of the corresponding silver halide grains in Samples 104, 108, 109 and 206.

Similarly, Samples 305 to 308 were prepared in absolutely the same manner as with Samples 104, 108, 109 and 206 except for changing the grain size of the light-sensitive silver halide grains in the above-mentioned emulsion layers to 1/1.36 times of that of the corresponding silver halide grains in Samples 104, 108, 109 and 206.

ISO speeds of Samples 301 to 308 so prepared were determined in the same manner as in Example 1. As a result, Samples 301 to 304 were found to have a speed of ISO 160.

Samples 104, 108, 109, 206 and 301 to 308 were cut into 135 size pieces. These pieces were used to photographs a soccer match under night illumination with mercury lamps at exposing conditions indicated in Table 6 below and subjected to development processing in the same manner as in Example 1.

The photographic performance characteristics of the development processed samples are shown in Table 6 below.

TABLE 6

| Sample No. | ISO Speed | Aperture 8 Shutter Speed 1/250 sec: Color Density | Aperture 8 Shutter Speed 1/250 sec: Focus | Aperture 8 Shutter Speed 1/125 sec: Color Density | Aperture 8 Shutter Speed 1/125 sec: Focus |
|---|---|---|---|---|---|
| 301* | 100 | too high with poor finish | good | a little high but acceptable | out of focus |
| 302* | 100 | too high with poor finish | good | a little high but acceptable | out of focus |
| 303* | 100 | too high with poor finish | good | a little high but acceptable | out of focus |
| 304* | 100 | too high with poor finish | good | a little high but acceptable | out of focus |
| 305* | 160 | a little high but acceptable | good | good | out of focus |
| 306** | 160 | a little high but acceptable | good | good | out of focus |
| 307** | 160 | a little high but acceptable | good | good | out of focus |

TABLE 6-continued

| Sample No. | ISO Speed | Aperture 8 Shutter Speed 1/250 sec | | Aperture 8 Shutter Speed 1/125 sec | |
|---|---|---|---|---|---|
| | | Color Density | Focus | Color Density | Focus |
| 308** | 160 | a little high but accept-able | good | good | out of focus |
| 104* | 400 | good | good | a little low but accept-able | out of focus |
| 108** | 400 | good | good | a little low but accept-able | out of focus |
| 109** | 400 | good | good | a little low but accept-able | out of focus |
| 206** | 400 | good | good | a little low but accept-able | out of focus |

*Comparison
**Invention

It is clear from Table 6 that the photographic light-sensitive materials having a speed of ISO 100 have an insufficient speed for photographing the abovedescribed soccer match.

The interimage effect of each of Samples 301 to 308, 104, 109, 109 and 206 were determined in the same manner as in Example 1, the results being shown in Table 7.

These samples were cut into 135-size pieces, and Macbeth color chart was photographed using them under daylight and under mercury lamp light, to compare color reproducibility. In this case the exposure was adjusted in accordance with the speed of each of the samples. The results are shown in Table 8 below.

TABLE 7

| Sample No. | Δlog E (R) | Δlog E (G) | Δlog E (B) |
|---|---|---|---|
| 301 (Comparison) | 0.13 | 0.12 | 0.12 |
| 302 (Comparison) | 0.18 | 0.17 | 0.17 |
| 303 (Comparison) | 0.25 | 0.24 | 0.22 |
| 304 (Comparison) | 0.35 | 0.34 | 0.28 |
| 305 (Comparison) | 0.07 | 0.07 | 0.06 |
| 306 (Invention) | 0.17 | 0.16 | 0.16 |
| 307 (Invention) | 0.24 | 0.23 | 0.20 |
| 308 (Invention) | 0.35 | 0.34 | 0.27 |
| 104 (Comparison) | 0.05 | 0.05 | 0.04 |
| 108 (Invention) | 0.16 | 0.15 | 0.14 |
| 109 (Invention) | 0.22 | 0.21 | 0.19 |
| 206 (Invention) | 0.34 | 0.33 | 0.25 |

TABLE 8

| Sample No. | Color Reproducibility in Photographing under Daylight | | Difference in Color Reproducibility between Photographing under Daylight and Photographing under Mercury Lamp Light (Difference in Color Balance) |
|---|---|---|---|
| | Saturation | Hue | |
| 301 (Comparison) | Δ | ○ | ○ |
| 302 (Comparison) | ○ | ○ | ○ |
| 303 (Comparison) | ○ | ○ | ○ |
| 304 (Comparison) | ○ | ○ | ○ |
| 305 (Comparison) | x | ○ | ○ |
| 306 (Invention) | ○ | ○ | ○ |
| 307 (Invention) | ○ | ○ | ○ |
| 308 (Invention) | ○ | ○ | ○ |
| 104 (Comparison) | x | ○ | Δ |
| 108 (Invention) | ○ | ○ | ○ |
| 109 (Invention) | ○ | ○ | ○ |
| 206 (Invention) | ○ | ○ | ○ |

Saturation:
◎: extremely high
○: high
x: low
Δ: slightly low
Hue:
○: with good fidelity to an object
Color balance:
○: small difference in color balance
Δ: slightly large difference in color balance It is clear from Table 7 that with the samples having a speed of ISO 160 or more the effect of the content of silver iodide of light-sensitive silver halide emulsions on the interimage effect is remarkably larger than with the samples having a speed of ISO 100. In other words, when the speed becomes higher the interimage effect tends to become lower and, when the content of silver iodide of the light-sensitive silver halide emulsions is specified in accordance with the present invention, the interimage effect becomes remarkable.

From Table 8 it is clear that, with the high speed color reversal photographic materials which are suitable for photographing sports, the color reproducibility deteriorates when the spectral sensitivity distribution of the red-sensitive emulsion layer is specified in accordance with the present invention in order to lessen change in color balance due to difference in photographing light source, but the color reproducibility is improved by means for providing interimage effect.

The present invention provides a method of forming a color image using a silver halide color reversal photographic material having a high sensitivity and an excellent color reproducibility.

In addition, the above-described light-sensitive material undergoes an extremely small variation in photographic properties for change in exposure light source, thus having marked practical advantages.

While the invention has been described in detail and with reference to specific embodiments thereof, it will be apparent to one skilled in the art that various changes and modifications can be made therein without departing from the spirit and scope thereof.

What is claimed is:

1. A method of forming a color image which comprises subjecting a silver halide color reversal photographic material to imagewise exposure and then to color reversal processing, said color reversal processing comprising a black-and-white development as a first development followed by a reversal and a color development, said color reversal photographic material comprising a support having provided thereon at least one cyan coupler-containing red-sensitive silver halide emulsion layer, at least one magenta coupler-containing green-sensitive silver halide emulsion layer and at least one yellow coupler-containing blue-sensitive silver halide emulsion layer with the light-sensitive silver halide emulsions in said photographic material having an average silver iodide content of up to 5 mol %, a wavelength corresponding to the peak of spectral sensitivity distribution of said red-sensitive emulsion layer is in a range between 615 nm and 640 nm, a wavelength in shorter wavelength side of the spectral sensitivity distribution at which the sensitivity is 80% of the peak is in the range between 600 and 633 nm, a wavelength at which the sensitivity is 50% of the peak is in a range between 585 and 625 nm, a wavelength at which the sensitivity is 25% of the peak is in a range between 570 and 615 nm, a wavelength in longer wavelength side of the spectral sensitivity distribution at which the sensitivity is 80% of the peak is in a range between 620 and 648 nm, a wavelength at which the sensitivity is 50% of the peak is in a range between 625 and 655 nm, a wavelength at which the sensitivity is 25% of the peak is in a range between 630 and 665 nm, and the wavelength difference between the wavelength on the longer wavelength side at which the sensitivity is 25% of the peak and that on the shorter wavelength side at which the sensitivity is 25% of the peak is in a range of 90 to 30 nm, and the light-sensitive emulsion layers and/or a substantially light-insensitive hydrophilic colloidal layer has a means for providing interimage effect.

2. The method of forming a color image according to claim 1, wherein the means for providing the interimage effect comprises a difference in average silver iodide content sensitivities (at least one layer for each color sensitivity) of 1 mol % or more.

3. The method of forming a color image according to claim 1, wherein the means for providing the interimage effect comprises a compound represented by the following general formula (IV):

$$A-(Time)_t-X \qquad (IV)$$

wherein A is an oxidation-reduction mother nucleus and represents atoms capable of releasing $-(Time)_t-X$ only when oxidized during photographic development processing, Time represents a timing group bound to A through a sulfur atom, a nitrogen atom or a oxygen atom, t represents an integer of 0 or 1, and X represents a development inhibitor.

4. The method of forming a color image according to claim 1, wherein the means for providing the interimage effect comprises a compound represented by the following general formula (V):

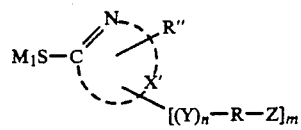

(V)

wherein $M_1$ represents a hydrogen atom, a cation or a mercapto group-protecting group capable of being split with alkali, Z represents atoms necessary for forming a 5- or 6-membered hetero ring, R represents a straight or branched alkylene group, a straight or branched alkenylene group, a straight or branched aralkylene group or an arylene group, Z represents a polar substituent, Y represents

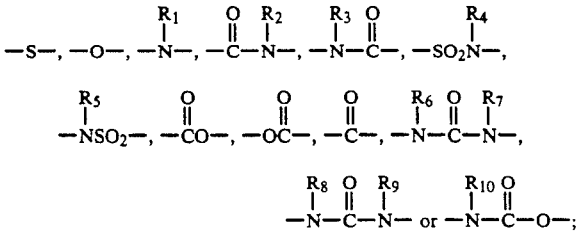

wherein $R_1$, $R_2$, $R_3$, $R_4$, $R_5$, $R_6$, $R_7$, $R_8$, $R_9$ and $R_{10}$ each represents a hydrogen atom or a substituted or unsubstituted alkyl, aryl, alkenyl or aralkyl group, and R″ represents a hydrogen atom or a group capable of replacing it, n represents 0 or 1, and m represents 0, 1 or 2.

5. The method of forming a color image according to claim 1, wherein the means for providing the interimage effect comprises a diffusible 4-thiazoline-2-thione compound or N-substituted-4-thiazoline-2-thione compound.

6. The method of forming a color image according to claim 1, wherein the means for providing the interimage effect comprises silver halide emulsion surface-fogged silver halide grains.

7. The method of forming a color image according to claim 1, wherein the means for providing the interimage effect comprises a silver halide emulsion containing interior-fogged silver halide grains.

8. The method of forming a color image according to claim 1, wherein the means for providing the interimage effect comprises colloidal silver.

9. The method of forming a color image according to claim 1, wherein the means for providing the interimage effect comprises an electron donor-releasing coupler.

10. The method of forming a color image according to claim 1, wherein the means for providing the interimage effect comprises the following means (1) and a means selected from the following means (2), (3), (5) and (6):

means (1): a difference in average silver iodide content between light-sensitive layers of different color sensitivities (at least one layer for each color sensitivity) of 1 mol % or more;

means (2): a compound represented by the following general formula (IV):

$$A-(Time)_t-X \qquad (IV)$$

wherein A means an oxidation-reduction mother nucleus and represents atoms capable of releasing $-(Time)_t-X$ only when oxidized during photographic development processing, Time represents a timing group bound to A through a sulfur atom, a nitrogen atom or an oxygen atom, t represents an integer of 0 or 1, and X represents a development inhibitor;

means (3): a compound represented by the following general formula (V):

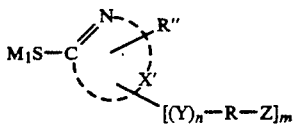

(V)

wherein $M_1$ represents a hydrogen atom, a cation or a mercapto group-protecting group capable of being split with alkali, Z represents atoms necessary for forming a 5- or 6-membered hetero ring, X represents atoms necessary for forming a 5- or 6-membered hetero ring;

means (5): a silver halide emulsion containing surface-fogged silver halide grains;

means (6): a silver halide emulsion containing interior-fogged silver halide grains.

11. The method of forming a color image according to claim 1, wherein the color reversal processing comprises one of the following processing sequences (1) to (4):

processing sequence (1): effecting, in sequence, first development, water wash, reversal, color development, adjusting, bleaching, fixing, water wash and stabilization;

processing sequence (2): effecting, in sequence, first development, water wash, reversal, color development, bleaching, bleach-fixing, water wash and stabilization;

processing sequence (3): effecting, in sequence, first development, water wash, reversal, color development, bleaching, bleach-fixing, water wash and stabilization;

processing sequence (4): effecting, in sequence, prehardening, water wash, first development, water wash, reversal, color development, water wash, bleaching, fixing, water wash and stabilization.

12. The method of forming a color image according to claim 1, wherein the average silver iodide content is from 1 to 4.8 mol %.

* * * * *